US007211357B2

(12) United States Patent
Hosoi et al.

(10) Patent No.: US 7,211,357 B2
(45) Date of Patent: May 1, 2007

(54) ELECTROPHOTOGRAPHIC PHOTOSENSITIVE MEMBER

(75) Inventors: Kazuto Hosoi, Shizuoka (JP); Toshiyuki Ehara, Kanagawa (JP); Hideaki Matsuoka, Shizuoka (JP); Satoshi Kojima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 356 days.

(21) Appl. No.: 10/901,174

(22) Filed: Jul. 29, 2004

(65) Prior Publication Data

US 2005/0026057 A1 Feb. 3, 2005

(30) Foreign Application Priority Data

Jul. 31, 2003 (JP) ..... 2003-284170
Jul. 22, 2004 (JP) ..... 2004-213908

(51) Int. Cl.
*G03G 5/082* (2006.01)

(52) U.S. Cl. ..... 430/56; 430/57.4

(58) Field of Classification Search ..... 430/56, 430/57.4

See application file for complete search history.

(56) References Cited

U.S. PATENT DOCUMENTS 4,592,982 A * 6/1986 Saitoh et al. ..... 430/57.5
4,642,279 A * 2/1987 Tanigami et al. ..... 430/66
4,659,639 A 4/1987 Mizuno et al. ..... 430/65
5,514,506 A 5/1996 Takai et al. ..... 430/57
5,556,729 A 9/1996 Fukuda et al. ..... 430/65
5,582,944 A 12/1996 Yamamura et al. ..... 430/66
5,738,963 A * 4/1998 Niino ..... 430/57.7
6,090,513 A 7/2000 Niino et al. ..... 430/65
6,238,832 B1 5/2001 Hashizume et al. ..... 430/67
6,586,149 B2 7/2003 Kawamura et al. ..... 430/66
6,635,397 B2 10/2003 Okamura et al. ..... 430/65
2003/0104029 A1 6/2003 Okamura et al. ..... 430/65
2004/0209179 A1* 10/2004 Hosoi et al. ..... 430/57.4

FOREIGN PATENT DOCUMENTS

JP 6-242623 9/1994
JP 11-242349 9/1999

* cited by examiner

*Primary Examiner*—John L Goodrow
(74) *Attorney, Agent, or Firm*—Fitzpatrick, Cella, Harper & Scinto

(57) ABSTRACT

Provided is an electrophotographic photosensitive member having a photoconductive layer on an electrically conductive substrate, the photoconductive layer being formed from a non-single-crystal material constituted by at least silicon atoms as a base material, and a non-single-crystal layer region constituted by silicon atoms and carbon atoms as base materials, the non-single-crystal layer region being laminated on the photoconductive layer, in which the content distribution of the oxygen atoms to a total amount of component atoms in a thickness direction within the non-single-crystal layer region has a peak.

24 Claims, 7 Drawing Sheets

ELECTROPHOTOGRAPHIC PHOTOSENSITIVE MEMBER

This application claims priorities from Japanese Patent Applications No. 2003-284170 filed on Jul. 31, 2003 and No. 2004-213908 filed on Jul. 22, 2004, which are hereby incorporated by reference herein.

BACKGROUND OF THE INVENTION

1. Field of the Invention

The present invention relates to an electrophotographic photosensitive member sensitive to electromagnetic waves such as light (which is light in the broad sense of the word and means ultraviolet rays, visible rays, infrared rays, X-rays, γ-rays, etc.).

2. Related Background Art

A photoconductive material which forms a photoconductive layer of an electrophotographic photosensitive member is required to have high sensitivity, a high SN ratio [photocurrent (Ip)/dark current (Id)] and an absorption spectrum suited to the spectral characteristics of the light with which the photoconductive material is irradiated, and to be harmless to the human body during use, and amorphous silicon (referred to also as "a-Si") which exhibits excellent properties in this respect and in particular, hydrogenated amorphous silicon (referred to also as "a-Si:H") has hitherto been put to wide application.

In general, a conductive substrate is heated to 50° C. to 350° C. and such an a-Si-based photoconductive material is formed on this substrate by film deposition methods such as the vacuum evaporation method, the sputtering method, the ion plating method, the thermal CVD method, the optical CVD method and the plasma CVD method. Among others, the plasma CVD method, i.e., a method by which a raw material gas is decomposed by high frequency or microwave glow discharge and an a-Si:H deposited film is formed on a substrate has been widely used as a favorable method.

In recent years, in association with the widespread use of computers in offices and general homes and the digitization of sentences and images, electrophotographic apparatus as output units have also been digitized and the formation of latent images by use of a light source the main component of which is single wavelength has becoming mainstream. On the other hand, as a result of improvements of an optical exposure device, a development device, a transfer device, etc. within an electrophotographic apparatus, also in electrophotographic photosensitive members, an improvement in the image characteristics has also begun to be required more than before.

In a conventional electrophotographic photosensitive member, in order to make improvements in the electrical, optical and photoconductive characteristics, such as dark resistance value, photosensitivity and optical response, the environmental characteristics such as moisture resistance the and temporal stability of a photoconductive member having a photoconductive layer formed from a-Si deposited film, electrical potential characteristics excellent in electric charging capacity and optical sensitivity are obtained by providing a surface barrier-wall layer formed from a non-photoconductive amorphous material containing silicon atoms and carbon atoms on a photoconductive layer formed from an amorphous material constituted by silicon atoms as a base material, as described, for example, in the Japanese Patent Application Laid-Open No. S57-115556.

Furthermore, in some conventional electrophotographic photosensitive members, as described in the Japanese Patent Application Laid-Open No. H06-242623 (U.S. Pat. No. 5,556,729), excellent electrophotographic characteristics are obtained by providing, between a photoconductive layer and a surface layer of an electrophotographic photosensitive member for negative charging, a hole capturing layer which is mainly formed from amorphous silicon and either contains less than 50 ppm of boron by atom or does not contain any element governing conductivity.

Also, in some cases, as described in the Japanese Patent Application Laid-Open No. H11-242349 (U.S. Pat. No. 6,238,832), an electrophotographic photosensitive member of high image quality excellent in electrical characteristics which does not develop exfoliation, damage and wear after use for a long time is obtained by causing at least oxygen, nitrogen, fluorine and boron atoms are all to be simultaneously contained in a surface layer of the electrophotographic photosensitive member.

Although good electrophotographic photosensitive members have been realized owing to the technological development as described above, the level of market requirements for products which are produced is becoming higher day by day and higher-quality electrophotographic photosensitive members are demanded.

Particularly, in digital electrophotographic apparatus and digital full-color electrophotographic apparatus which have come into remarkable widespread use, copies of not only originals in letters, but also photographs, pictures, design drawings, etc. are frequently generated and, therefore, an improvement in dot reproducibility has become required more than before. For example, when high resolution is to be achieved by decreasing the dot pitch of an image, dot reproducibility may sometimes become unstable, thereby causing the image flow phenomenon. Also, simultaneously, as a challenge to higher image quality, it has become more required than before to reduce optical memories represented by the ghost phenomenon and to increase sensitivity.

In order to solve these problems, the optimization of layer construction and film quality improvements for digital exposure and the control of element contents have been carried out as described above. However, as described above, the level of market requirements for images is very high and further improvements in image characteristics are strongly demanded. In recent years, electrophotographic photosensitive members used in digital electrophotographic apparatus have been required to provide higher durability than before. When the film thickness of a surface layer is increased in order to meet this requirement, a charge carrier which forms a latent image becomes apt to diffuse laterally. For this reason, dot reproducibility may sometimes become unstable and a technique for controlling the lateral diffusion of a charge carrier is strongly demanded.

In digital full-color electrophotographic apparatus, a negative toner which has the widest range of material selection as a color toner as the most common combination of charging, development, etc., and an image exposure method (a method of exposing image portion) which provides high controllability of latent images and is suitable for high image quality design are conceivable, and on that occasion, it is necessary to cause a photosensitive member to be electrically charged with a negative electric charge. In an a-Si-based photosensitive member for negative electrification which has hitherto been devised in digital full-color electrophotographic apparatus, it is desirable to provide an upper charge injection blocking layer in order to block the injection of negative charges from the surface as much as possible, and how to improve a non-single-crystal layer region constituted by silicon atoms and carbon atoms as base materials, including this upper charge injection blocking layer, is a clew to improvements in the characteristics.

Particularly, with respect to the recent requirements for digital full-color electrophotographic apparatus, overall improvements in the characteristics of photosensitive members to a greater extent than before have become necessary. And there is a case where the distance from a charging device to a developing device becomes apt to increase because for example, as one of the process conditions, a plurality of developing devices are provided around an electrophotographic photosensitive member or large-sized developing means are used. For this reason, in order to compensate for a decrease in potential from a charging device to a developing device due to dark attenuation, it is necessary to raise the charge potential more than before and hence an upper charge injection blocking layer is becoming more and more important.

SUMMARY OF THE INVENTION

The object of the present invention is to provide a high-quality electrophotographic photosensitive member excellent in image characteristics. That is, the object is to provide an electrophotographic photosensitive member which enables an improvement in dot reproducibility, an improvement in charging capacity, and furthermore a reduction of optical memories and an increase in sensitivity to be achieved.

To achieve the above-described object, the present invention provides an electrophotographic photosensitive member having a photoconductive layer on an electrically conductive substrate and a non-single-crystal layer region, wherein the photoconductive layer is formed from a non-single-crystal material constituted by at least silicon atoms as a base material, the non-single-crystal layer region is constituted by silicon atoms and carbon atoms as base materials, the non-single-crystal layer region is laminated on the photoconductive layer, the non-single-crystal layer region contains oxygen atoms, and the content distribution of the oxygen atoms to a total amount of component atoms in a thickness direction within the non-single-crystal layer region has a peak.

Also, the present invention provides an electrophotographic photosensitive member having a photoconductive layer on an electrically conductive substrate and a non-single-crystal layer region, wherein the photoconductive layer is formed from a non-single-crystal material constituted by at least silicon atoms as a base material, and the non-single-crystal layer region is constituted by silicon atoms and carbon atoms as base materials, the non-single-crystal layer region is laminated on the photoconductive layer, the non-single-crystal layer region contains fluorine atoms, and the content distribution of the fluorine atoms to a total amount of component atoms in a thickness direction of the non-single-crystal layer region has a peak.

Furthermore, the present invention provides an electrophotographic photosensitive member having a photoconductive layer on an electrically conductive substrate and a non-single-crystal layer region, wherein the photoconductive layer is formed from a non-single-crystal material constituted by at least silicon atoms as a base material, the non-single-crystal layer region is constituted by silicon atoms and carbon atoms as base materials, the non-single-crystal layer region is laminated on the photoconductive layer, the non-single-crystal layer region contains oxygen atoms and fluorine atoms, the content distribution of the oxygen atoms to a total amount of component atoms in a thickness direction of the non-single-crystal layer region has a peak, and the content distribution of fluorine atoms to a total amount of component atoms in a thickness direction within the non-single-crystal layer region has a peak.

DESCRIPTION OF THE PREFERRED EMBODIMENTS

Figure 1A:
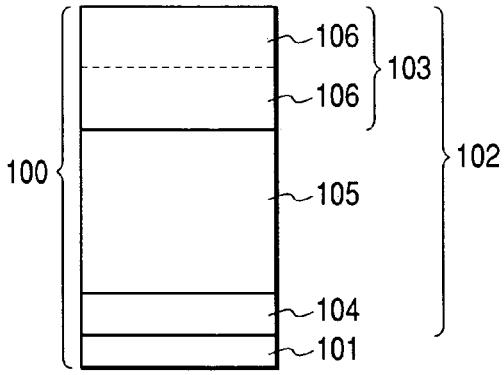
FIGS. 1A, 1B, 1C and 1D are each a schematic sectional view to explain examples of an electrophotographic photosensitive member of the present invention.

To achieve the above-described object, the present inventors devoted themselves to examinations and, as a result, found that controlling a composition in a non-single-crystal layer region constituted by silicon atoms and carbon atoms as base materials, which is laminated on a photoconductive layer, has a great effect on image characteristics. Furthermore, finding out that within a non-single-crystal layer region constituted by silicon atoms and carbon atoms as base materials, which is laminated on a photoconductive layer, by controlling a composition so that the contents of the oxygen atoms and/or the fluorine atoms have a peak, improvements in the electrophotographic characteristics, such as an improvement in dot reproducibility, furthermore, an improvement in charging capacity, a reduction of optical memories and an increase in sensitivity, can be achieved, the present inventors have come to complete the present invention.

That is, the present invention is as follows.

The present invention relates to an electrophotographic photosensitive member having a photoconductive layer on an electrically conductive substrate and a non-single-crystal layer region, wherein the photoconductive layer is formed from a non-single-crystal material constituted by at least silicon atoms as a base material, the non-single-crystal layer region is constituted by silicon atoms and carbon atoms as base materials, the non-single-crystal layer region is laminated on the photoconductive layer, the non-single-crystal layer region contains oxygen atoms, and the content distribution of oxygen atoms to a total amount of component atoms in a thickness direction within the non-single-crystal layer region has a peak. "A thickness direction within the non-single-crystal layer region" refers to a plane perpendicular to a plane which forms layers.

Furthermore, it is preferred that the present invention provide an electrophotographic photosensitive member, in which within the non-single-crystal layer region there is a region containing a Group 13 element.

Furthermore, it is preferred that the present invention provides an electrophotographic photosensitive member, in which the content distribution of carbon atoms to a total amount of component atoms within the non-single-crystal layer region constituted by silicon atoms and carbon atoms as base materials have at least two maximum regions in a thickness direction within the non-single-crystal layer region.

Furthermore, it is preferred that the present invention provides an electrophotographic photosensitive member, in which in a thickness direction within a layer region which is nearer to the conductive layer side than a minimum value present between the two maximum regions of carbon atom content, there be the peak of the content distribution of oxygen atoms to a total amount of component atoms.

Furthermore, it is preferred that the present invention provides an electrophotographic photosensitive member, in which when a maximum content at a peak of the content distribution of oxygen atoms within the non-single-crystal layer region constituted by silicon atoms and carbon atoms as base materials, which is laminated on the photoconductive layer, is denoted by Omax and a minimum content of oxygen atoms contained within the non-single-crystal layer region is denoted by Omin, the ratio of the maximum content Omax to the minimum content Omin satisfies the relationship $2 \leqq Omax/Omin \leqq 2000$.

Incidentally, the minimum content Omin is a minimum content in the non-single-crystal layer region containing no change region, which is laminated adjoining the photoconductive layer.

Furthermore, it is preferred that the present invention provides an electrophotographic photosensitive member, in which at a peak of the content distribution of oxygen atoms within the non-single-crystal layer region constituted by silicon atoms and carbon atoms as base materials, which is laminated on the photoconductive layer, the half-value breadth of the peak be not less than 10 nm but not more than 200 nm.

Furthermore, it is preferred that the present invention provides an electrophotographic photosensitive member, in which the peak of content distribution of oxygen atoms does not have a constant region.

Also, the present invention relates to an electrophotographic photosensitive member having a photoconductive layer on an electrically conductive substrate and a non-single-crystal layer region, wherein the photoconductive layer is formed from a non-single-crystal material constituted by at least silicon atoms as a base material, and the non-single-crystal layer region is constituted by silicon atoms and carbon atoms as base materials, the non-single-crystal layer region is laminated on the photoconductive layer, the non-single-crystal layer region contains fluorine atoms, and the content distribution of fluorine atoms to a total amount of component atoms in a thickness direction within the non-single-crystal layer region has a peak.

Furthermore, it is preferred that the present invention provide an electrophotographic photosensitive member, in which in a thickness direction within a film region which is nearer to the conductive layer side than a minimum value present between the two maximum regions of carbon atom content, there be the peak of the content distribution of oxygen atoms to a total amount of component atoms.

Furthermore, it is preferred that the present invention provide an electrophotographic photosensitive member, in which when a maximum content at a peak of the content distribution of fluorine atoms within said non-single-crystal layer region constituted by silicon atoms and carbon atoms as base materials, which is laminated on the photoconductive layer, is denoted by Fmax and a minimum content of fluorine atoms contained within said non-single-crystal layer region is denoted by Fmin, the ratio of the maximum content Fmax to the minimum content Fmin satisfies the relationship $2 \leqq Fmax/Fmin \leqq 2000$.

Incidentally, the minimum content Fmin is a minimum content in the non-single-crystal layer region containing no change region, which is laminated adjoining the photoconductive layer.

Furthermore, it is preferred that the present invention provide an electrophotographic photosensitive member, in which at a peak of the content distribution of fluorine atoms within the non-single-crystal layer region constituted by silicon atoms and carbon atoms as base materials, which is laminated on the photoconductive layer, the half-value breadth of the peak is not less than 10 nm but not more than 200 nm.

Furthermore, it is preferred that the present invention provide an electrophotographic photosensitive member, in which the peak of content distribution of fluorine atoms does not have a constant region.

Also, the present invention relates to an electrophotographic photosensitive member having a photoconductive layer on an electrically conductive substrate and a non-single-crystal layer region, wherein the photoconductive layer is formed from a non-single-crystal material constituted by at least silicon atoms as a base material, the non-single-crystal layer region is constituted by silicon atoms and carbon atoms as base materials, the non-single-crystal layer region is laminated on the photoconductive layer, the non-single-crystal layer region contains oxygen atoms and fluorine atoms, the content distribution of oxygen atoms to a total amount of component atoms in a thickness direction within the non-single-crystal layer region has a peak, and the content distribution of fluorine atoms to a total amount of component atoms in a thickness direction within the non-single-crystal layer region has a peak.

Furthermore, it is preferred that the present invention provide an electrophotographic photosensitive member, in which in a thickness direction within a film region which is nearer to the conductive layer side than a minimum value present between the two maximum regions of carbon atom content, there are the peaks of the content distribution of oxygen atoms and fluorine atoms to a total amount of component atoms.

Furthermore, it is preferred that the present invention provide an electrophotographic photosensitive member, in which when a maximum content at the peaks of the content distribution of oxygen atoms and fluorine atoms within the non-single-crystal layer region constituted by silicon atoms and carbon atoms as base materials, which is laminated on the photoconductive layer, is each denoted by Omax and Fmax and a minimum content of oxygen atoms and fluorine atoms contained within the non-single-crystal layer region is each denoted by Omin and Fmin, the ratio of the maximum content Omax, Fmax to the minimum content Omin, Fmin satisfies the relationship $2 \leqq Omax/Omin \leqq 2000$ and the relationship $2 \leqq Fmax/Fmin \leqq 2000$.

Incidentally, the minimum contents Omin and Fmin are each a minimum content in the non-single-crystal layer region containing no change region, which is laminated adjoining the photoconductive layer.

Furthermore, it is preferred that the present invention provide an electrophotographic photosensitive member, in which at the peaks of the content distribution of oxygen atoms and fluorine atoms within the non-single-crystal layer region constituted by silicon atoms and carbon atoms as base materials, which is laminated on the photoconductive layer, the half-value breadth of each of the peaks is not less than 10 nm but not more than 200 nm for oxygen atoms and not less than 10 nm but not more than 200 nm for fluorine atoms.

Furthermore, it is preferred that the present invention provide an electrophotographic photosensitive member, in which the peaks of content distribution of oxygen atoms and fluorine atoms do not have a constant region.

Knowledge which has lead to the achievement of an improvement in dot reproducibility, furthermore an improvement in charging capacity, a reduction of optical memories and an increase in sensitivity will be describe in detail below.

The present inventors consider an improvement in dot reproducibility as follows. Within a non-single-crystal layer region constituted by silicon atoms and carbon atoms as base materials, which is laminated on a photoconductive layer, a composition is controlled so that the content of oxygen atoms and/or fluorine atoms has a peak, whereby the diffusion of charges which forms a latent image, which is the cause of impairing dot reproducibility, can be effectively prevented and as a result of this, dot reproducibility is improved.

Furthermore, it became apparent that ensuring a peak of the content of oxygen atoms and/or fluorine atoms is effective not only in improving dot reproducibility, but also in increasing the charging capacity of an electrophotographic photosensitive member, improving photosensitivity and reducing optical memories, thus exhibiting the multiplier effect. It might be thought that atoms of oxygen and fluorine promote the structure relaxation of a non-single-crystal layer constituted by silicon atoms and carbon atoms as base materials and remove structural defects by this, and at the same time atoms of oxygen and fluorine work effectively as terminators and thereby effectively reduce localized level densities ascribed to structural defects present in a film. For this reason, this results in the prevention of the migration of charges via structural defects within the non-single-crystal layer region constituted by silicon atoms and carbon atoms as base materials, which is laminated on the photoconductive layer, thereby contributing to an improvement in charging capacity. Furthermore, it might be considered that because a light carrier is prevented from being trapped by a localized level, this leads to an increase in sensitivity a reduction of optical memories.

Furthermore, the present inventors closely examined effects in the case where the content of oxygen atoms and/or fluorine atoms has a peak in a thickness direction within the non-single-crystal layer region constituted by silicon atoms and carbon atoms as base materials, which is laminated on the photoconductive layer. As a result, it became apparent that when the content of oxygen atoms has a peak, the diffusion of charges works more efficiently than the case where the content of fluorine atoms has a peak, thereby contributing to a remarkable improvement in dot reproducibility, though the reason is unknown. Also, it became apparent that when the content of both oxygen atoms and fluorine atoms has a peak, structure relaxation within the non-single-crystal layer region works effectively compared to a case where the content of either oxygen atoms or fluorine atoms has a peak, resulting in a remarkable increase in charging capacity and photosensitivity and also in a reduction of optical memories.

Furthermore, the present inventors examined the construction of layers within a film region which are laminated on the photoconductive layer and, as a result, it became apparent that an improvement in dot reproducibility is made remarkable by providing an electrophotographic photosensitive member for negative charging in which within the non-single-crystal layer region constituted by silicon atoms and carbon atoms as base materials, which is laminated on the photoconductive layer, there is a region containing a Group 13 element of the periodic table. Although the reason is unknown at the present moment, it might be considered that the fact that in the case of negative charging, a charge carrier is an electron has a bearing.

Furthermore, the present inventors examined the construction of layers within a non-single-crystal layer region laminated on a photosensitive layer in an electrophotographic photosensitive member for negative charging. As a result, it became apparent that an improvement in charging capacity, an increase in sensitivity and also a further reduction of optical memories become possible when the content distribution of carbon atoms to a total amount of component atoms has at least two maximum regions in a thickness direction within the non-single-crystal layer region and when in a thickness direction within a layer region which is nearer to the conductive layer side than a minimum value present between the two maximum regions of carbon atom content, the content distribution of carbon atoms to a total amount of component atoms has a peak in a thickness direction within the layer region. It might be considered that owing to the structure relaxation of the non-single-crystal layer constituted by silicon atoms and carbon atoms as base materials, a decrease in the structural defects within the film works effectively, leading to a further improvement in charging capacity, increase in sensitivity and reduction of optical memories.

Furthermore, the present inventors made a close investigation into the correlation between the content of oxygen atoms and/or fluorine atoms within the non-single-crystal layer region constituted by silicon atoms and carbon atoms as base materials, which is laminated on the photoconductive layer, and the electrophotographic characteristics. As a result, they found that in addition to an improvement in dot reproducibility, an improvement in charging capacity, an increase in photosensitivity and also a reduction of optical memories are all dramatically made possible by performing control so that when a maximum content at a peak of the content distribution of oxygen atoms and fluorine atoms is each denoted by Omax and Fmax and a minimum content of oxygen atoms and fluorine atoms contained within the non-single-crystal layer region laminated on the photoconductive layer (the non-single-crystal layer which adjoin the photoconductive layer and does not contain a change region) is each denoted by Omin and Fmin, the ratio of the maximum content Omax, Fmax to the minimum content Omin, Fmin satisfies the relationship $2 \leqq Omax/Omin \leqq 2000$ and the relationship $2 \leqq Fmax/Fmin \leqq 2000$.

Furthermore, the present inventors found that the effects of the present invention become more remarkable when Omax is in the range of from $5.0\times10^{20}$ atoms/cm$^3$ to $2.5\times10^{22}$ atoms/cm$^3$, Omin is in the range of from $2.5\times10^{17}$ atoms/cm$^3$ to $1.3\times10^{22}$ atoms/cm$^3$, and when Fmax is in the range of from $5.0\times10^{19}$ atoms/cm$^3$ to $2.0\times10^{22}$ atoms/cm$^3$ and Fmin is in the range of from $2.5\times10^{17}$ atoms/cm$^3$ to $1.0\times10^{22}$ atoms/cm$^3$, and also when Omax is in the range of from $5.0\times10^{20}$ atoms/cm$^3$ to $2.5\times10^{22}$ atoms/cm$^3$, Omin is in the range of from $2.5\times10^{17}$ atoms/cm$^3$ to $1.3\times10^{22}$ atoms/cm$^3$, Fmax is in the range of from $5.0\times10^{19}$ atoms/cm$^3$ to $2.0\times10^{22}$ atoms/cm$^3$ and Fmin is in the range of from $2.5\times10^{17}$ atoms/cm$^3$ to $1.0\times10^{22}$ atoms/cm$^3$.

Furthermore, as a result of the close investigation into the correlation between the content of oxygen atoms and/or fluorine atoms within the non-single-crystal layer region constituted by silicon atoms and carbon atoms as base materials, which is laminated on the photoconductive layer, and the electrophotographic characteristics, the present inventors found that at a peak of the content distribution of oxygen atoms and/or fluorine atoms, it is desirable to control the half-value breadth of the peak to not less than 10 nm but not more than 200 nm. It might be thought that by controlling the half-value breadth of the peak to not less than 10 nm, the formation of the peak effectively has an effect on film characteristics, permitting a further improvement in charging capacity and a further increase in photosensitivity. On the other hand, it might be thought that by controlling the half-value breadth of the peak to not more than 200 nm, it becomes possible to further improve dot reproducibility and to thoroughly reduce optical memories without impairing the film quality in the region near the peak.

Furthermore, the present inventors made a close investigation into the correlation between a peak of the content distribution of oxygen atoms and/or fluorine atoms within the non-single-crystal layer region constituted by silicon atoms and carbon atoms as base materials, which is laminated on the photoconductive layer, and the electrophotographic characteristics. As a result, they consider that performing control so that a peak shape does not have a constant region ensures that in addition to an improvement in dot reproducibility and charging capacity, it becomes possible to increase sensitivity and to thoroughly reduce optical memories.

According to the present invention, by performing composition control so that within the non-single-crystal layer region constituted by silicon atoms and carbon atoms as base materials, which is laminated on the photoconductive layer, the contents of oxygen atoms and fluorine atoms have a peak, it is possible to achieve improvements in the electrophotographic characteristics, such as an improvement in dot reproducibility, an improvement in charging capacity, a reduction of optical memories and an increase in sensitivity.

An electrophotographic photosensitive member of the present invention will be described in detail with reference to the accompanying drawings.

FIG. 1A to FIG. 1D are each a schematic structural drawing to explain examples of layer construction of an electrophotographic photosensitive member of the present invention.

In an electrophotographic photosensitive member 100 shown in FIG. 1A, a light receiving layer 102 is provided on a substrate 101 for the electrophotographic photosensitive member. The light receiving layer 102 is constituted, in order from the substrate 101 side, by an a-Si-based lower charge injection blocking layer 104, a photoconductive layer 105 formed from a-Si:H and having photoconductivity, and a non-single-crystal layer region 103 constituted by silicon atoms and carbon atoms as base materials. The non-single-crystal region 103 constituted by silicon atoms and carbon atoms as base materials is constituted by a surface layer 106 of amorphous silicon carbide hydride (referred to also as "a-SiC:H"). Incidentally, the broken line in the a-SiC:H-based surface layer 106 indicates a peak formation region of the content of oxygen atoms and/or fluorine atoms of the present invention. For the interface between the photoconductive layer 105 and the surface layer 106, interface control may be performed so as to suppress interface reflection by providing a change region.

Figure 1B:
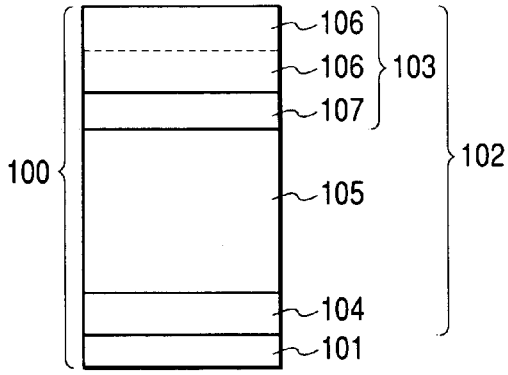

An electrophotographic photosensitive member 100 shown in FIG. 1B is an electrophotographic photosensitive member for negative charging, and a light receiving layer 102 is provided on a substrate 101. The light receiving layer 102 is constituted, in order from the substrate 101 side, by an a-Si-based lower charge injection blocking layer 104, a photoconductive layer 105 formed from a-Si:H and having photoconductivity, and a non-single-crystal region 103 constituted by silicon atoms and carbon atoms as base materials. The non-single-crystal region 103 constituted by silicon atoms and carbon atoms as base materials is constituted by an a-SiC:H-based upper charge injection blocking 107 formed from a region containing a Group 13 element of the periodic table, and an a-SiC:H-based surface layer 106. Incidentally, the broken line in the a-SiC:H-based surface layer 106 indicates a peak formation region of the content of oxygen atoms and/or fluorine atoms of the present invention. For each of the interfaces between the photoconductive layer 105 and the upper charge injection blocking layer 107, and between the upper charge injection blocking 107 and the surface layer 106, interface control may be performed so as to suppress interface reflection by providing a change region.

Figure 1C:
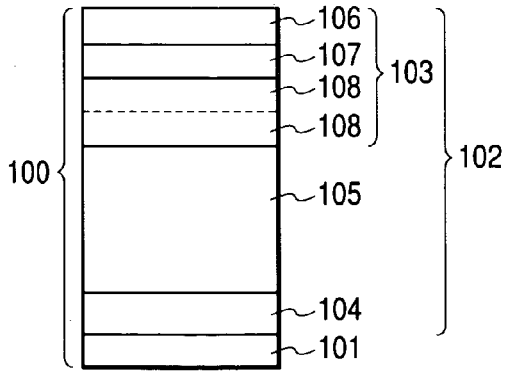

An electrophotographic photosensitive member 100 shown in FIG. 1C is an electrophotographic photosensitive member for negative charging, and a light receiving layer 102 is provided on a substrate 101. The light receiving layer 102 is constituted, in order from the substrate 101 side, by an a-Si-based lower charge injection blocking layer 104, a photoconductive layer 105 formed from a-Si:H and having photoconductivity, and a non-single-crystal region 103 constituted by silicon atoms and carbon atoms as base materials. The non-single-crystal region 103 constituted by silicon atoms and carbon atoms as base materials is constituted by an intermediate 108 formed from a-SiC:H, an a-SiC:H-based upper charge injection blocking layer 107 formed from a region containing a Group 13 element of the periodic table, and an a-SiC:H-based surface layer 106. Incidentally, the broken line in the a-SiC:H-based intermediate 108 indicates a peak formation region of the content of oxygen atoms and/or fluorine atoms of the present invention. For each of the interfaces between the photoconductive layer 105 and the intermediate layer 108, between the intermediate 108 and the upper charge injection blocking layer 107, and between the upper charge injection blocking 107 and the surface layer 106, interface control may be performed so as to suppress interface reflection by providing a change region.

Figure 1D:
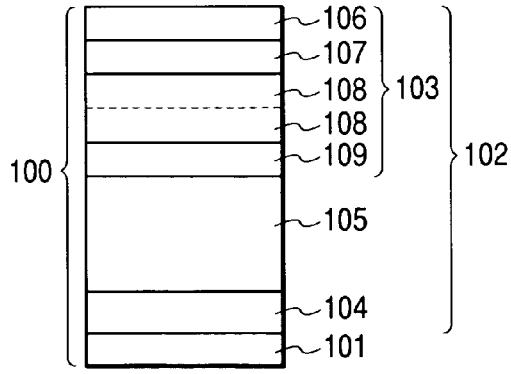

An electrophotographic photosensitive member 100 shown in FIG. 1D is an electrophotographic photosensitive member for negative charging, and a light receiving layer 102 is provided on a substrate 101. The light receiving layer 102 is constituted, in order from the substrate 101 side, by an a-Si-based lower charge injection blocking layer 104, a photoconductive layer 105 formed from a-Si:H and having photoconductivity, and a non-single-crystal region 103 constituted by silicon atoms and carbon atoms as base materials. The non-single-crystal region 103 constituted by silicon atoms and carbon atoms as base materials is constituted by a first a-SiC:H-based upper charge injection blocking layer 109 formed from a region containing a Group 13 of the periodic table, an intermediate 108 formed from a-SiC:H, a second a-SiC:H-based upper charge injection blocking 107 formed from a region containing a Group 13 element of the periodic table, and an a-SiC:H-based surface layer 106. Incidentally, the broken line in the a-SiC:H-based intermediate 108 indicates a peak formation region of the content of oxygen atoms and/or fluorine atoms of the present invention. For each of the interfaces between the photoconductive layer 105 and the first upper charge injection blocking layer 109, between the first upper charge injection blocking layer 109 and the intermediate layer 108, between the intermediate 108 and the second upper charge injection blocking layer 107, and between the second upper charge injection blocking 107 and the surface layer 106, interface control may be performed so as to suppress interface reflection by providing a change region.

Next, the non-single-crystal region constituted by silicon atoms and carbon atoms as base materials will be described.

As shown in FIGS. 1A to 1D, the numeral 103 denotes a non-single-crystal region constituted by silicon atoms and carbon atoms as base materials, deposited on a photoconductive layer. The non-single-crystal region 103 constituted by silicon atoms and carbon atoms as base materials is constituted by the surface layer 106 in FIG. 1A, the upper charge injection blocking 107 and the surface layer 106 in FIG. 1B, the intermediate layer 108, the upper charge injection blocking layer 107, and the surface layer 106 in FIG. 1C, and the first upper charge injection blocking layer 109, the intermediate layer 108, the second upper charge injection blocking layer 107, and the surface layer 106 in FIG. 1D.

A peak formation region of the content of oxygen atoms and/or fluorine atoms of the present invention is indicated by the broken line in the surface layer 106 in FIG. 1A, the broken line in the surface layer 106 in FIG. 1B, the broken line in the intermediate 108 in FIG. 1C, and the broken line in the intermediate 108 in FIG. 1D.

Each of the layers will be described in detail below.

<Surface Layer>

The surface layer 106 in the present invention is provided to obtain good characteristics, mainly in moisture resistance, continuously repeated use characteristics, environmental characteristics, durability and electrical characteristics, and has also the role as a charge holding layer in the case of an electrophotographic photosensitive member for positive charging.

The material for the surface layer 106 in the present invention is formed from a non-single-crystal material constituted by silicon atoms and carbon atoms as base materials. The carbon atoms contained in the above-described surface layer 106 may be uniformly distributed all over in this layer or may be contained in a condition nonuniformly distributed in a layer thickness direction. In both cases, however, in an in-plane direction parallel to the surface of the substrate 101, it is necessary that the carbon atoms be contained all over in a uniform distribution also from the standpoint of making the characteristics in an in-plane direction uniform.

Also, the content of the carbon atoms contained in the above-described surface layer 106 is preferably not less than 40 atomic % but not more than 95 atomic % to a total amount of carbon atoms and silicon atoms. This content is more preferably not less than 50 atomic % but not more than 90 atomic %. When the content of carbon atoms is in this range, good wear resistance is obtained and sensitivity becomes also good.

It is preferred that hydrogen atoms be contained in the surface layer 106, and in this case, hydrogen atoms compensate for dangling bonds of components atoms such as silicon atoms, thereby improving layer quality, in particular, photoconductive characteristics and charge holding characteristics. From this point of view, the content of hydrogen atoms is preferably not less than 30 atomic % but not more than 70 atomic % to a total amount of component atoms in the surface layer, more preferably not less than 35 atomic % but not more than 65 atomic %, and most preferably not less than 40 atomic % but not more than 60 atomic %.

It is preferred that the layer thickness of the above-described surface layer 106 be usually not less than 10 nm but not more than 5000 nm, advantageously not less than 50 nm but not more than 2000 nm, and optimally not less than 100 nm but not more than 1000 nm. When the layer thickness is not less than 10 nm, the surface layer 106 is not lost for reasons of wear during the use of an a-Si-based photosensitive member. When it is ensured that the layer thickness is not more than 5000 nm, a deterioration in the electrophotographic characteristics such as an increase in residual potential does not occur, either.

In order to form a surface layer 106 having characteristics capable of achieving the object of the present invention, it is necessary to appropriately set the substrate temperature and the gas pressure in a reactor in a desired manner. Usually, the substrate temperature (Ts), an optimum range of which is appropriately selected according to layer design, is preferably not less than 150° C. but not more than 350° C., more preferably not less than 180° C. but not more than 330° C. and optimally not less than 200° C. but not more than 300° C.

Similarly, an optimum range of the pressure in a reactor is appropriately selected according to layer design. The pressure in a reactor is usually not less than $1\times10^{-2}$ Pa but not more than $1\times10^{3}$ Pa, preferably not less than $5\times10^{-2}$ Pa but not more than $5\times10^{2}$ Pa, and optimally not less than $1\times10^{-1}$ Pa but not more than $1\times10^{2}$ Pa.

In the present invention, the above-described ranges can be mentioned as desirable ranges of numerical values of the substrate temperature and gas pressure for forming the surface layer 106. Usually, however, conditions are not independently determined and it is desirable to determine optimum values on the basis of mutual and organic relationships in order to form a photosensitive member having the desired characteristics.

A change region in which the content of carbon atoms decreases toward the photoconductive layer may be provided between the surface layer and the photoconductive layer. As a result of this, it becomes possible to improve the adhesion of the surface layer to the photoconductive layer and to further reduce the effect of interference by the reflection of light at the interface.

Furthermore, in the present invention, in the surface layer 106 shown in FIG. 1A, control is performed so that the content of oxygen atoms and/or fluorine atoms has a peak, for example, in the place of the broken line. In order to form a peak, it is desirable to cause a gas for the supply of oxygen atoms and/or fluorine atoms to flow during the formation of the surface layer 106. In order to control the content of oxygen atoms and/or fluorine atoms contained in the surface layer 106, it is effective to appropriately control, for example, the gas concentration of a gas for the supply of oxygen atoms and/or fluorine atoms and deposition film forming conditions, such as high frequency power and substrate temperature.

Gases such as $O_2$, CO, $CO_2$, NO, $N_2O$ and $CO_2$ are enumerated as substances that can be used as a gas for the supply of oxygen atoms. For substances that can be used as a gas for the supply of fluorine atoms, gases such as fluorine gas ($F_2$), $CF_4$, $SiF_4$, $Si_2F_6$, BrF, ClF and $ClF_3$ are enumerated as desirable ones. For a gas for the supply of oxygen atoms and fluorine atoms, it is desirable to mix plural kinds of the above-described gases and concretely, a mixed gas of $CF_4$ and $O_2$ is mentioned as a desirable example.

The content of oxygen atoms in the surface layer 106 is preferably $1.0\times10^{17}$ to $2.5\times10^{22}$ atoms/cm$^3$, more preferably $5.0\times10^{17}$ to $2.0\times10^{22}$ atoms/cm$^3$ and optimally $1.0\times10^{18}$ to $1.0\times10^{22}$ atoms/cm$^3$. Similarly, the content of fluorine atoms in the surface layer 106 is preferably $1.0\times10^{16}$ to $2.0\times10^{22}$ atoms/cm$^3$, more preferably $5.0\times10^{16}$ to $5.0\times10^{22}$ atoms/cm$^3$ and optimally $1.0\times10^{17}$ to $2.5\times10^{21}$ atoms/cm$^3$.

Figure 3:
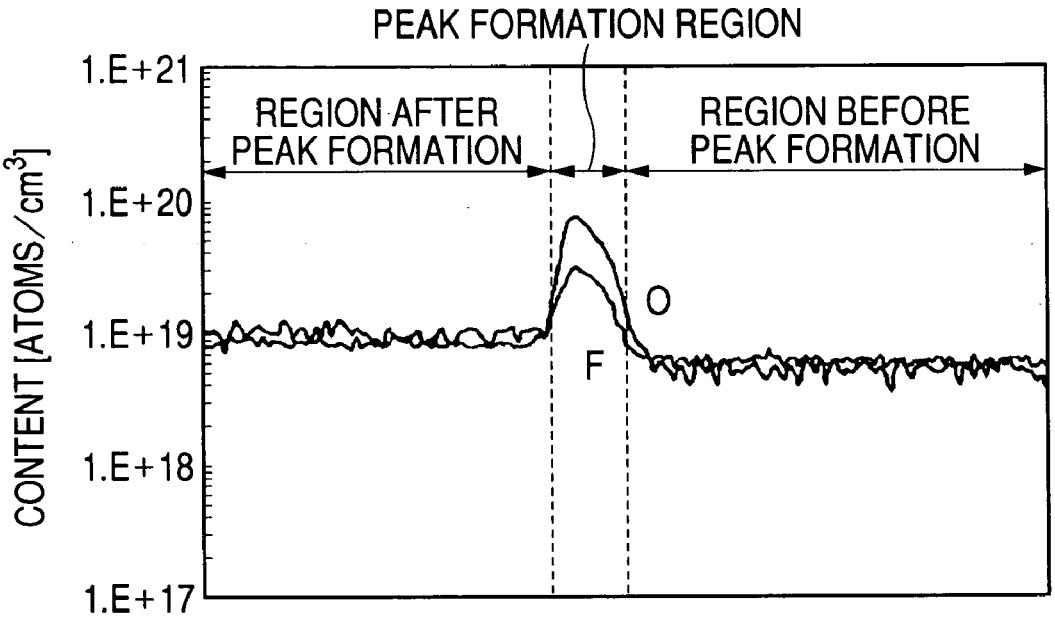
FIG. 3 is an example of a depth profile to explain peaks of the content of oxygen atoms and fluorine atoms in a surface layer in the present invention.

The content of oxygen atoms and/or fluorine atoms in the surface layer 106 can be in a distribution condition as shown in FIG. 3, for example.

FIG. 3 shows an example of a depth profile to explain a peak of the content of oxygen atoms and/or fluorine atoms in the surface layer by SIMS (secondary ion mass spectrometry). FIG. 3 shows a case where the depth profile of the content of oxygen atoms and/or fluorine atoms has a peak and a minimum content in the surface layer. When a maximum content at a peak of the content distribution of oxygen atoms and fluorine atoms is each denoted by Omax and Fmax and a minimum content of oxygen atoms and fluorine atoms in the non-single-crystal layer region is each denoted by Omin and Fmin, it is preferred that the ratio of the maximum content Omax, Fmax to the minimum content Omin, Fmin satisfy the relationship $2\leqq Omax/Omin\leqq 2000$ and the relationship $2\leqq Fmax/Fmin\leqq 2000$. It is preferred that Omax be in the range of $5.0\times10^{20}$ atoms/cm$^3$ to $2.5\times10^{22}$ atoms/cm$^3$, and that Omin be in the range of $2.5\times10^{17}$ atoms/cm to $1.3\times10^{22}$ atoms/cm$^3$. It is preferred that Fmax be in the range of $5.0\times10^{19}$ atoms/cm$^3$ to $2.0\times10^{22}$ atoms/cm$^3$, and that Fmin be in the range of $2.5\times10^{17}$ atoms/cm$^3$ to $1.0\times10^{22}$ atoms/cm$^3$.

The minimum content defined here indicates a minimum value of the content in the non-single-crystal layer region constituted by silicon atoms and carbon atoms as base materials which is laminated on the photoconductive layer and does not contain a change region adjoining the photoconductive region.

Figure 4:
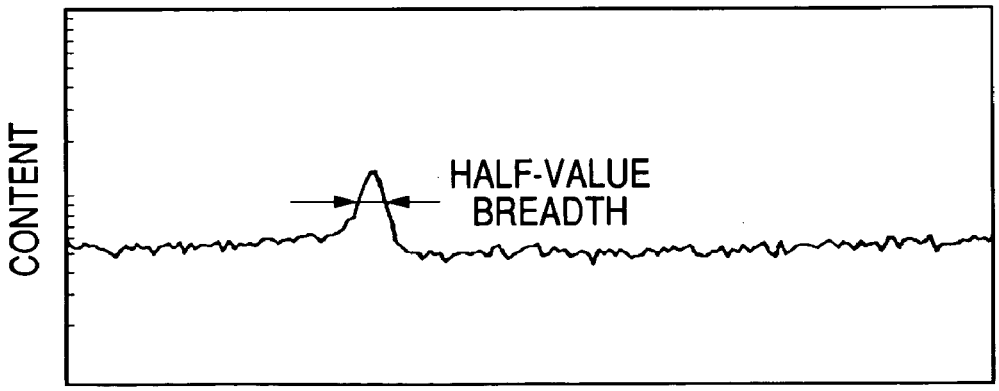
FIG. 4 is an example of an explanation of the half-value breadth of a peak in a surface layer in the present invention.

FIG. 4 is an example to explain the half-value breadth of a peak in a surface layer. In the depth profile of the content of oxygen atoms and/or fluorine atoms, it is more preferred that at a peak of the content distribution of oxygen atoms and fluorine atoms in the surface layer, the half-value breadth of each of the peaks be not less than 10 nm but not more than 200 nm for oxygen atoms and not less than 10 nm but not more than 200 nm for fluorine atoms.

In the present invention, it is preferred that the peak of content distribution of oxygen atoms and/or fluorine atoms have a shape which does not have a constant region. Concretely, it is preferred that as in the shape formed in the peak formation region of FIG. 3, a shape in which a top exists in the peak of the content be shown. The case where a peak has a constant region means that in analytical results, oxygen atoms and/or fluorine atoms continue to exist with a constant value in a thickness direction of the surface layer. Incidentally, although the description was here given of the case where the peak formation region of oxygen atoms and/or fluorine atoms is present in the surface layer 106, the same applies to a case where the peak formation region is present in other places of the non-single-crystal layer region, for example, in the intermediate layer 108.

<Upper Charge Injection Blocking Layer>

In the present invention, for example as shown in FIG. 1B, providing the upper charge injection blocking 107 forming part of the light receiving layer 103 between the photoconductive layer 105 and the surface layer 106 provides a desirable structure to effectively achieve the object in the case of an electrophotographic photosensitive member for negative charging.

The upper charge injection blocking 107 of the present invention blocks the injection of charges from above (that is, from the surface layer side) and improves charging capacity. Furthermore, in order to ensure that in the region above the photoconductive layer 105, the content of Group 13 element of the periodic table to a total amount of component atoms has a distribution having at least two maximum regions in a thickness direction within the non-single-crystal layer region, it is more preferred that, for example, as shown in FIG. 1D, the upper charge injection blocking layer have a structure constituted by two layers of the first upper charge injection blocking layer 109 and the second upper charge injection blocking 107 via the intermediate layer 108. By ensuring at least two of maximum values and/or maximum regions for the above-described Group 13 element of the periodic table in a thickness direction within the non-single-crystal layer region, it is possible to obtain a further improvement in the capacity to block the injection of charges from the surface and to improve charging capacity.

Concretely, there are available boron (B), aluminum (Al), gallium (Ga), indium (In), thallium (Tl), etc. as the above-described Group 13 element of the periodic table, and boron is particularly preferred.

It is preferred that the content of Group 13 element of the periodic table contained in the upper charge injection blocking layers 107, 109 be in the range of not less than 60 ppm but not more than 5000 ppm to a total amount of component atoms, advantageously in the range of not less than 100 ppm but not more than 3000 ppm.

The Group 13 element of the periodic table contained in the upper charge injection blocking layers 107, 109 may be uniformly distributed all over in the upper charge injection blocking layers 107, 109 or may be contained in a condition nonuniformly distributed in a layer thickness direction. In both cases, however, in an in-plane direction parallel to the surface of the substrate, it is necessary that the Group 13 element of the periodic table be contained all over in a uniform distribution also from the standpoint of making the characteristics in an in-plane direction uniform.

In the present invention, the upper charge injection blocking layers 107, 109 are formed from a non-single-crystal layer constituted by silicon atoms and carbon atoms as a base material as with the surface layer 106. The silicon atoms and carbon atoms contained in the upper charge injection blocking layers 107, 109 may be uniformly distributed all over in the layers or may be contained in a condition nonuniformly distributed in a layer thickness direction. In both cases, however, in an in-plane direction parallel to the surface of the substrate, it is necessary that the silicon atoms and carbon atoms be contained all over in a uniform distribution also from the standpoint of making the characteristics in an in-plane direction uniform.

The content of the carbon atoms contained in each layer region of the upper charge injection blocking layers 107, 109 in the present invention is preferably in the range of not less than 10 atomic % to not more than 70 atomic % to a total of silicon atoms and carbon atoms, which are component atoms. It is more preferably not less than 15 atomic % but not more than 65 atomic % and most preferably not less than 20 atomic % but not more than 60 atomic %.

In the present invention, it is preferred that hydrogen atoms be contained in each layer region of the upper charge injection blocking layers 107, 109, and the hydrogen atoms compensate for dangling bonds of silicon atoms, thereby improving layer quality, in particular, photoconductive characteristics and charge holding characteristics. It is preferred that the content of hydrogen atoms be usually not less than 30 atomic % but not more than 70 atomic % to a total amount of component atoms in the upper charge injection blocking layer, advantageously not less than 35 atomic % but not more than 65 atomic %, and optimally not less than 40 atomic % but not more than 60 atomic %.

In the present invention, to ensure that the desired electrophotographic characteristics are obtained and from the standpoint of economic effect and the like, the layer thickness of each of the upper charge injection blocking layers 107, 109 is preferably not less than 10 nm but not more than 1000 nm, more preferably not less than 30 nm but not more than 800 nm, and optimally not less than 50 nm but not more than 500 nm. If the layer thickness is less than 10 nm, the blocking of the injection of charges from the surface side becomes insufficient and sufficient charging capacity is not obtained, with the result that the electrophotographic characteristics might sometimes deteriorate. If the layer thickness exceeds 1000 nm, an improvement in the electrophotographic characteristics cannot be expected and instead a decrease in characteristics such as sensitivity may sometimes be caused.

It is also desirable that in the upper charge injection blocking layers 107, 109, the composition be continuously changed from the photoconductive layer 105 side to the surface 106, and this is effective in improving adhesion and preventing interference and the like.

In order to form upper charge injection blocking layers 107, 109 having characteristics capable of achieving the object of the present invention, it is necessary to appropriately set the mixing ratio of a gas for the supply of silicon atoms to a gas for the supply of carbon atoms, the gas pressure in a reactor, discharge power and the substrate temperature.

When the upper charge injection blocking layers 107, 109 have a maximum region in a thickness direction of the content of Group 13 element of the periodic table, it is preferred that the content of Group 13 element of the periodic table in a maximum region nearest to the surface layer side be highest.

An optimum range of the pressure in a reactor is also appropriately selected similarly according to layer design. The pressure in a reactor is usually not less than $1\times10^{-2}$ Pa but not more than $1\times10^{3}$ Pa, preferably not less than $5\times10^{-2}$ Pa but not more than $5\times10^{2}$ Pa and optimally not less than $1\times10^{-1}$ Pa but not more than $1\times10^{2}$ Pa.

An optimum range of the substrate temperature is appropriately selected according to layer design. Usually, the substrate temperature is preferably not less than 150° C. but not more than 350° C., more preferably not less than 180° C. but not more than 330° C., and optimally not less than 200° C. but not more than 300° C.

<Intermediate Layer>

In the present invention, for example, as shown in FIG. 1C and FIG. 1D, in the case of an electrophotographic photosensitive member for negative charging, providing the intermediate layer 108 under the upper charge injection blocking layer 107 plays the role of the covering effect which improves surface irregularities and of improving the adhesion of the upper charge injection blocking layer 107. The intermediate 108 in the present invention is formed from a non-single-crystal material constituted by silicon atoms and carbon atoms as a base material. The carbon atoms contained in the intermediate 108 may be uniformly distributed all over in this layer or may be contained in a condition nonuniformly distributed in a layer thickness direction. In both cases, however, in an in-plane direction parallel to the surface of the substrate, it is necessary that the carbon atoms be contained all over in a uniform distribution also from the standpoint of making the characteristics in an in-plane direction uniform.

Also, the content of the carbon atoms contained in the above-described intermediate 108 is preferably not less than 40 atomic % but not more than 95 atomic % to a total amount of carbon atoms and silicon atoms, which are component atoms. This content is more preferably not less than 50 atomic % but not more than 90 atomic %.

In the intermediate 108 carbon atoms are contained in a larger amount than in the above-described first upper charge injection blocking layer 109 and second upper charge injection blocking layer 107. Although a Group 13 element of the periodic table may be contained in the intermediate layer 108, it is more preferred that the content of Group 13 element of the periodic table be not more than 50 atomic ppm to a total amount of component elements in the intermediate layer.

It is more preferred that the film thickness of the intermediate 108 be controlled so that the distance between the two adjacent maximum regions of Group 13 element of the periodic table in a thickness direction of the non-single-crystal layer region becomes not less than 100 nm but not more than 1000 nm. It is preferred that the thickness of the intermediate layer be usually not less than 50 nm but not more than 2000 nm, advantageously not less than 100 nm but not more than 1500 nm, and optimally not less than 200 nm but not more than 1000 nm.

Furthermore, in the present invention, in the intermediate 108 shown in FIG. 1C, control is performed so that the content of oxygen atoms and/or fluorine atoms has a peak, for example, in the place of the broken line. In order to form a peak, it is desirable to cause a gas for the supply of oxygen atoms and/or fluorine atoms to flow during the formation of the intermediate layer. In order to control the content of oxygen atoms and/or fluorine atoms contained in the intermediate layer 108, it is effective to appropriately control, for example, the gas concentration of a gas for the supply of oxygen atoms and/or fluorine atoms and deposited film forming conditions, such as high frequency power and substrate temperature.

Gases such as $O_2$, CO, $CO_2$, NO, $N_2O$ and $CO_2$ are enumerated as substances that can be used as a gas for the supply of oxygen atoms. For substances that can be used as a gas for the supply of fluorine atoms, gases such as fluorine gas ($F_2$), $CF_4$, $SiF_4$, $Si_2F_6$, BrF, ClF and $ClF_3$ are enumerated as desirable ones. For a gas for the supply of oxygen atoms and fluorine atoms, it is desirable to mix plural kinds of the above-described gases and concretely, a mixed gas of $CF_4$ and $O_2$ is mentioned as a desirable example.

The content of oxygen atoms in the intermediate 108 is preferably $1.0\times10^{17}$ to $2.5\times10^{22}$ atoms/cm$^3$, more preferably $5.0\times10^{17}$ to $2.0\times10^{22}$ atoms/cm$^3$ and optimally $1.0\times10^{18}$ to $1.0\times10^{22}$ atoms/cm$^3$. Similarly, the content of fluorine atoms in the intermediate 108 is preferably $1.0\times10^{16}$ to $2.0\times10^{22}$ atoms/cm$^3$, more preferably $5.0\times10^{16}$ to $5.0\times10^{21}$ atoms/cm$^3$ and optimally $1.0\times10^{17}$ to $2.5\times10^{21}$ atoms/cm$^3$.

When the SIMS depth profile of the content of oxygen atoms and/or fluorine atoms in the non-single-crystal layer region constituted by silicon atoms and carbon atoms as base materials which is laminated on the photoconductive layer has a peak in the intermediate layer and when a maximum content at a peak of oxygen atoms and fluorine atoms is each denoted by Omax and Fmax and a minimum content of oxygen atoms and fluorine atoms in the non-single-crystal layer region is each denoted by Omin and Fmin, it is preferred that the ratio of the maximum content Omax, Fmax to the minimum content Omin, Fmin satisfy the relationship $2\leqq Omax/Omin\leqq 2000$ and the relationship $2\leqq Fmax/Fmin\leqq 2000$. It is preferred that Omax be in the range of $5.0\times10^{20}$ atoms/cm$^3$ to $2.5\times10^{22}$ atoms/cm$^3$, and that Omin be in the range of $2.5\times10^{17}$ atoms/cm$^3$ to $1.3\times10^{22}$ atoms/cm$^3$. It is preferred that Fmax be in the range of $5.0\times10^{19}$ atoms/cm$^3$ to $2.0\times10^{22}$ atoms/cm$^3$, and that Fmin be in the range of $2.5\times10^{17}$ atoms/cm$^3$ to $1.0\times10^{22}$ atoms/cm$^3$.

The minimum content defined here indicates a minimum value of the content in the non-single-crystal layer region constituted by silicon atoms and carbon atoms as base materials which is laminated on the photoconductive layer and does not contain a change region adjoining the photoconductive region.

<Substrate>

As the substrate used in the present invention any substrate can be used so long as it is an electrically conductive one, and metals such as Al, Cr, Mo, Au, In, Nb, Te, V, Ti, Pt, Pd and Fe, and alloys of these metals, such as stainless steel, are enumerated as electrically conductive substrates.

Furthermore, even in the case of electrical insulating materials, for example, films or sheets of synthetic resins such as polyester, polyethylene, polycarbonate, cellulose acetate, polypropylene, polyvinyl chloride, polystyrene and polyamide, electrical insulating materials such as glass and ceramics can be used as a substrate by treating at least the surface on the side where the light receiving layer is to be formed so that this surface becomes a conductive one.

A substrate to be used can be in the shape of a cylinder or an endless belt having a smooth surface or a surface with micro irregularities and the thickness of the substrate is appropriately determined so as to be able to form the desired electrophotographic photosensitive member. When an electrophotographic photosensitive member is required to be flexible, the substrate can be reduced in thickness as far as possible so long as the substrate can fully exhibit its functions. However, the substrate is usually not less than 10 μm in terms of fabrication, handling, mechanical strength, etc.

<Lower Charge Injection Blocking Layer>

In the present invention, as shown in FIG. 1A to FIG. 1D, it is effective to provide the lower charge injection blocking layer 104, which works to block the injection of charges from the substrate 101 side, on the electrically conductive substrate 101. The lower charge injection blocking layer 104 has the function of blocking the injection of charges from the substrate 101 side to the photoconductive layer 105 side when a free surface of the light receiving layer 102 is subjected to charging treatment of constant polarity.

Impurities which control electrical conductivity of silicon atoms as a base material are contained in relatively large amounts in the lower charge injection blocking layer 104 compared to the photoconductive layer 105, which will be described in detail later. In the case of an electrophotographic photosensitive member for positive charging, Group 13 elements of the periodic table can be used as impurity elements contained in the lower charge injection blocking layer 104. In the case of an electrophotographic photosensitive member for negative charging, Group 15 elements of the periodic table can be used as impurity elements contained in the lower charge injection blocking layer 104. The content of impurities contained in the lower charge injection blocking layer 104, which is appropriately determined according to requirements to ensure that the object of the present invention is effectively achieved, is preferably not less than 10 atomic ppm but not more than 10,000 atomic ppm to a total amount of component elements in the lower charge injection blocking layer, more preferably not less than 50 atomic ppm but not more than 7,000 atomic ppm, and optimally not less than 100 atomic ppm but not more than 5,000 atomic ppm.

Furthermore, by causing nitrogen and oxygen to be contained in the lower charge injection blocking layer 104, it becomes possible to improve the adhesion between this lower charge injection blocking layer 104 and the substrate 101. In the case of an electrophotographic photosensitive member for negative charging, it is also possible to ensure an excellent charge injection blocking capacity by causing nitrogen and oxygen to be optimally contained even when the lower charge injection blocking layer 104 is not doped with impurity elements. Concretely, the charge injection blocking capacity is improved by ensuring that the content of nitrogen atoms and oxygen atoms contained in all layer regions of the lower charge injection blocking layer 104 is, as a sum of nitrogen and oxygen, preferably not less than 0.1 atomic % but not more than 40 atomic % to a total amount of atoms, which are component atoms in the lower charge injection blocking layer, more preferably not less than 1.2 atomic % but not more than 20 atomic %.

Furthermore, it is preferred that hydrogen atoms be contained in the lower charge injection blocking layer 104 in the present invention and, in this case, hydrogen atoms compensate for dangling bonds present in the layer, thereby being effective in improving film quality. The content of hydrogen atoms contained in the lower charge injection blocking layer 104 is preferably not less than 1 atomic % but not more than 50 atomic % to a total amount of component elements in the lower charge injection blocking layer, more preferably not less than 5 atomic % but not more than 40 atomic %, and most preferably not less than 10 atomic % but not more than 30 atomic %.

In the present invention, to ensure that the desired electrophotographic characteristics are obtained and from the standpoint of economic effect and the like, the layer thickness of the lower charge injection blocking layers 104 is preferably not less than 100 nm but not more than 5,000 nm, more preferably not less than 300 nm but not more than 4,000 nm, and optimally not less than 500 nm but not more than 3,000 nm. By ensuring a layer thickness of not less than 100 nm but not more than 5,000 nm, the capacity to block the injection of charges from the substrate 101 becomes sufficient and a sufficient charging capacity is obtained. At the same time, an improvement in the electrophotographic characteristics can be expected and adverse effects such as an increase in residual potential do not occur.

In forming the lower charge injection blocking layer 104, it is necessary to appropriately set the gas pressure in a reactor, discharge power and the substrate temperature. Usually, the substrate temperature (Ts), an optimum range of which is appropriately selected according to layer design, is preferably not less than 150° C. but not more than 350° C., more preferably not less than 180° C. but not more than 330° C. and optimally not less than 200° C. but not more than 300° C. Similarly, an optimum range of the pressure in a reactor is appropriately selected according to layer design. The pressure in a reactor is usually not less than $1\times10^{-2}$ Pa but not more than $1\times10^{3}$ Pa, preferably not less than $5\times10^{-2}$ Pa but not more than $5\times10^{2}$ Pa, and optimally not less than $1\times10^{-1}$ Pa but not more than $1\times10^{2}$ Pa.

<Photoconductive Layer>

The photoconductive layer 105 in an electrophotographic photosensitive member of the present invention is formed from a non-single-crystal material constituted by silicon atoms as a base material, and it is preferred that hydrogen atoms and/or halogen atoms be contained in the layer. This is for compensating for dangling bonds of silicon atoms, thereby improving layer quality, in particular, photoconductivity and charge holding characteristics. It is preferred that the content of hydrogen atoms or halogen atoms or the amount of a sum of hydrogen atoms and halogen atoms be preferably not less than 10 atomic % but not more than 40 atomic % to a total amount of component atoms in the photoconductive layer, more preferably not less than 15 atomic % but not more than 25 atomic %. In order to control the quantity of hydrogen atoms and/or halogen atoms contained in the photoconductive layer 105, it is necessary only that, for example, the temperature of the substrate 101, the quantity of raw material substances which are introduced into a reactor in order to cause hydrogen atoms and/or halogen atoms to be contained, discharge power, etc. be controlled.

In the present invention, impurity elements which control electrical conductivity may be contained in the photoconductive layer 105 as required. In the same manner as with the lower charge blocking layer 104, Group 13 elements of the periodic table can be used as impurity elements to be contained. The content of impurity elements contained in the photoconductive layer 105 is preferably not less than $1\times10^{-2}$ atomic ppm but not more than $1\times10^{4}$ atomic ppm, more preferably not less than $5\times10^{-2}$ atomic ppm but not more than $5\times10^{3}$ atomic ppm, and optimally not less than $1\times10^{-1}$ atomic ppm but not more than $1\times10^{3}$ atomic ppm.

In the present invention, the layer thickness of the photoconductive layers 105, which is determined to ensure that the desired electrophotographic characteristics are obtained and from the standpoint of economic effect and the like, is preferably not less than 10 μm but not more than 50 μm, more preferably not less than 20 μm but not more than 45 μm, and optimally not less than 25 μm but not more than 40 μm.

In forming the photoconductive layer 105, it is necessary to appropriately set the gas pressure in a reactor, discharge power and the substrate temperature. Usually, the substrate temperature (Ts), an optimum range of which is appropriately selected according to layer design, is preferably not less than 150° C. but not more than 350° C., more preferably not less than 180° C. but not more than 330° C. and optimally not less than 200° C. but not more than 300° C.

Similarly, an optimum range of the pressure in a reactor is appropriately selected according to layer design. The pressure in a reactor is usually not less than $1\times10^{-2}$ Pa but not more than $1\times10^{3}$ Pa, preferably not less than $5\times10^{-2}$ Pa but not more than $5\times10^{2}$ Pa, and optimally not less than $1\times10^{-1}$ Pa but not more than $1\times10^{2}$ Pa.

Next, an apparatus and a film forming method to fabricate the light receiving layer 102 of the present invention will be described in detail.

Figure 2:
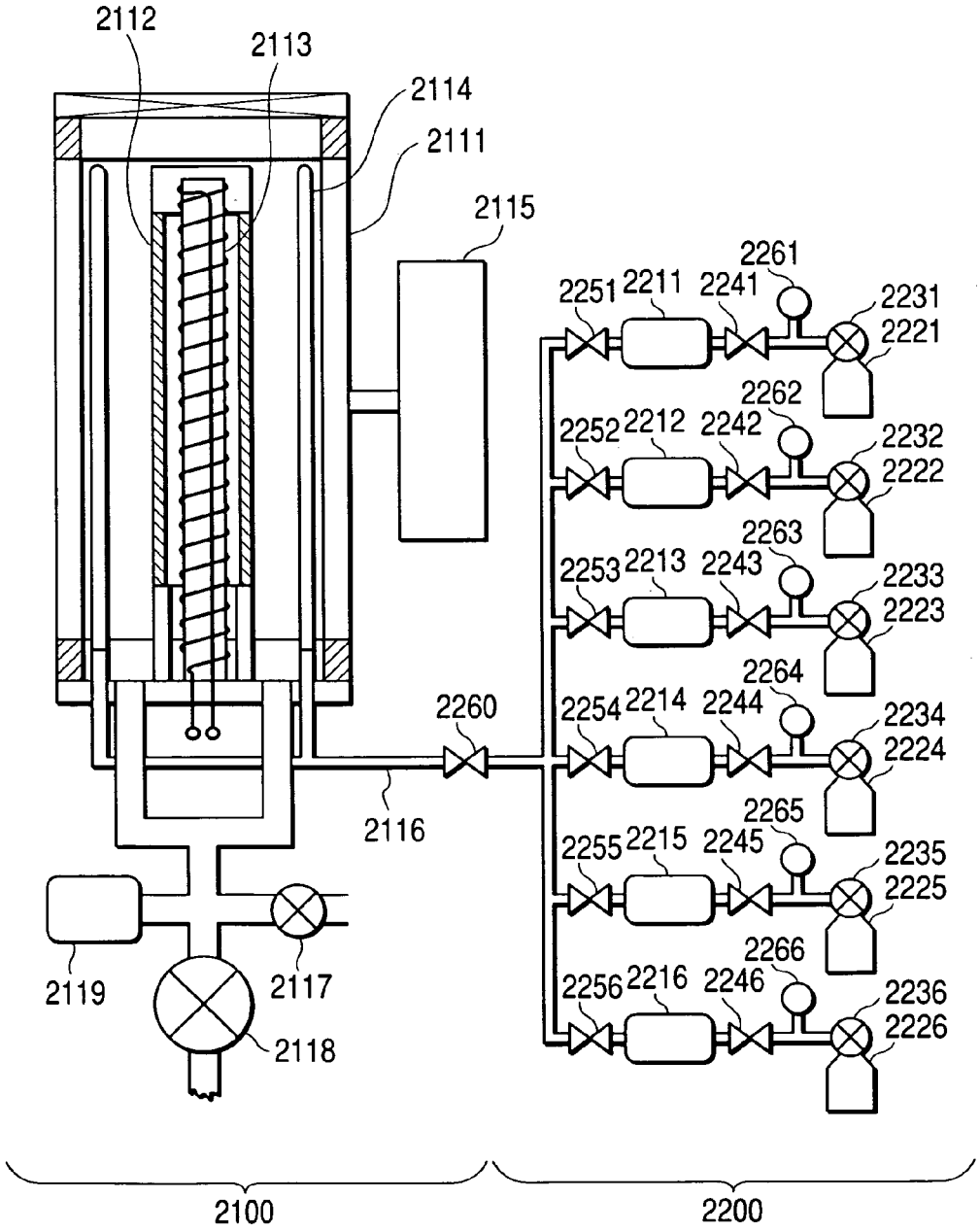
FIG. 2 is a schematic explanatory drawing which shows an example of a manufacturing device of an electrophotographic photosensitive member of the present invention.

FIG. 2 is a schematic structural drawing which shows an example of a manufacturing apparatus of an electrophotographic photosensitive member by the high-frequency plasma CVD method (also abbreviated as the RF-PCVD method) using the RF band as power frequency. The construction of the manufacturing apparatus shown in FIG. 2 is as follows.

This apparatus is broadly constituted by a deposition device (2100), a raw material gas supply device (2200), and an exhaust device (not shown) which reduces the pressure in a reactor (2111). A cylindrical substrate (2112), a heater (2113) for heating the substrate and a raw material gas introduction pipe (2114) are provided within a reactor (2111) in the deposition device (2100), and a high-frequency matching box (2115) is connected to the reactor.

The raw material gas supply device (2200) is constituted by steel cylinders (2221 to 2226) of raw material gases such as $SiH_4$, $GeH_4$, $H_2$, $CH_4$, $B_2H_6$ and $PH_3$, valves (2231 to 2236, 2241 to 2246, 2251 to 2256), and mass flow controllers (2211 to 2216), and the steel cylinders of each raw material gas are connected to the gas introduction pipe (2114) in the reactor (2111) via an auxiliary valve (2260).

The formation of a deposited film using this device can be performed, for examples, as follows.

First, the cylindrical substrate (2112) is installed in the reactor (2111) and gases in the reactor (2111) are exhausted by use of the exhaust device which is not shown(for example, a vacuum pump). Subsequently, the temperature of the cylindrical substrate (2112) is controlled to a prescribed temperature between 150° C. and 350° C. by the heater (2113) for heating the substrate.

In causing the raw material gases for forming a deposited film to flow into the reactor (2111), after it is first ascertained that the valves (2231 to 2236) of the gas cylinders and a leak valve (2117) of the reactor are closed and that the gas inflow valves (2241 to 2246), the gas outflow valves (2251 to 2256) and the auxiliary valve (2260) are open, gases in the reactor (2111) and raw material gas pipe (2116) are first exhausted by opening a main valve (2118).

Next, when the reading of a vacuum gauge (2119) has become not more than about 0.1 Pa, the auxiliary valve (2260) and the gas outflow valves (2251 to 2256) are closed. After that, by opening the raw material gas cylinder valves (2231 to 2236), each gas is introduced from the gas cylinders (2221 to 2226) and each gas pressure is adjusted to 0.2 MPa by use of pressure regulators (2261 to 2266). Next, by gradually opening the gas inflow valves (2241 to 2246), each gas is introduced into the mass flow controllers (2211 to 2216).

When preparations for film forming have been completed as described above, each layer is formed by the following procedure.

When the temperature of the cylindrical substrate (2112) has reached a prescribed level, necessary ones among the gas outflow valves (2251 to 2256) and the auxiliary valve (2260) are gradually opened and prescribed gases are introduced from the gas cylinders (2221 to 2226) into the reactor (2111) via the raw material gas introduction pipe (2114). Next, adjustments are made by use of the mass flow controllers (2211 to 2216) so that each raw material gas obtains a prescribed flow rate. On that occasion, the opening of the main valve (2118) is adjusted while observing the vacuum gauge (2119) so that the pressure in the reactor (2111) becomes a prescribed pressure of not more than $1\times10^2$ Pa. When the inner pressure has become stable, an RF power supply (not shown) of frequency of 13.56 MHz to the desired power and the RF power is introduced into the reactor (2111) via the high-frequency matching box (2115), whereby a glow discharge is generated. The raw material gases introduced into the reactor are decomposed by this discharge energy and a prescribed deposited film which is mainly composed of silicon is formed on the cylindrical substrate (2112). After the formation of a prescribed deposited film having the desired film thickness, the supply of the RF power is stopped, the inflow of the gases into the reactor is stopped by closing the outflow valves, and the formation of the deposited film is completed.

By repeating the same operation multiple times, a light receiving layer of the desired multilayer structure is formed. In forming each layer, it is needless to say that the outflow valves for other than necessary gases are all to be closed, and in order to prevent each gas from remaining in the reactor (2111) and in the piping from the outflow valves (2251 to 2256) to the reactor (2111), an operation to exhaust gases in the system to a high vacuum is performed as required by closing the outflow valves (2251 to 2256), opening the auxiliary valve (2260) and fully opening the main valve (2118).

In order to make film formation uniform, it is also effective to rotate the cylindrical substrate (2112) at a predetermined speed by use of a driving device (not shown) during the film formation.

Furthermore, it is needless to say that the above-described kinds of gases and valve operations may be changed by fabrication conditions of each layer.

In heating the substrate, any heating element may be used so long as it is of vacuum specification. More concretely, it is possible to enumerate electrical resistance heating elements, such as a sheath-like heater, a wound heater, a plate-like heater and a ceramic heater, heating elements by a heat radiation lamp, such as a halogen lamp and an infrared lamp, heat exchange means using liquids, gases, etc. as heating mediums, etc. Metals such as stainless steel, nickel, aluminum and copper, ceramics, heat resisting polymer resins, etc. can be used as the material for the surface of heating means.

Additionally, it is possible to adopt a method by which a vessel only for heating is provided in addition to the reactor and after heating, the substrate is transported to the reactor in a vacuum.

Figure 5:
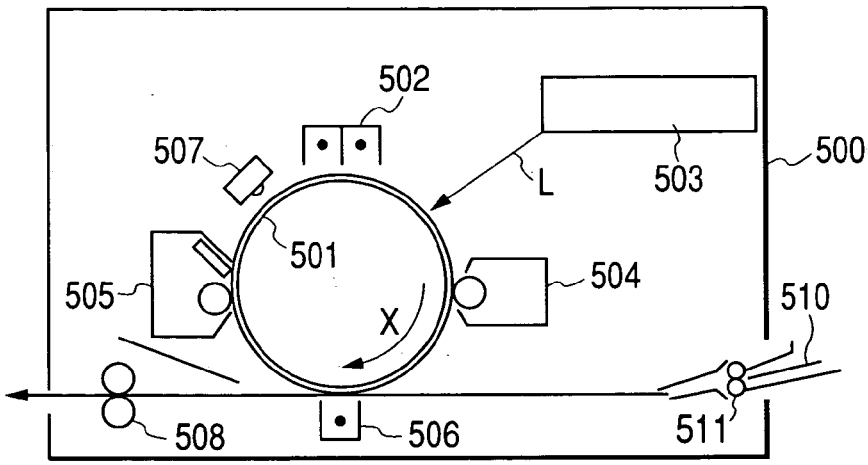
FIG. 5 is a schematic explanatory drawing which shows an example of a digital electrophotographic apparatus in which an electrophotographic photosensitive member of the present invention is provided.

An example of a digital electrophotographic apparatus in which an electrophotographic photosensitive member of the present invention is used is shown in FIG. 5. In FIG. 5, the numeral 500 denotes a digital electrophotographic apparatus, the numeral 501 denotes an electrophotographic photosensitive member called in the present invention, and the numeral 502 is a corona charging device which performs charging for forming an electrostatic latent image on this photosensitive member 501. The numeral 503 denotes an exposure device which is electrostatic latent image forming means. The numeral 504 denotes a developing device for supplying a developer (toner) to the electrophotographic photosensitive member 501 with the electrostatic latent image formed thereon. The numeral 506 denotes a transfer charging device to transfer a toner on the surface of the photosensitive member to a transfer material. The numeral 505 is a cleaner which cleans the surface of the photosensitive member. In this example, the surface of the photosensitive member is cleaned by use of an elastic roller and a cleaning blade in order to effectively perform the uniform cleaning of the surface of the photosensitive member. The numeral 507 denotes a charge elimination lamp which performs the charge elimination of the surface of the photosensitive member in preparation for the next copying action. The numeral 508 denotes a fixing device. The numeral 510 denotes a transfer material such as a sheet of paper and the numeral 511 denotes a transfer roller for a transfer material. A light source the main component of which is single wavelength, such as a laser and an LED, is used as the light source of exposure light L.

By use of such an apparatus the formation of a copy image is performed, for example, as described below. First, the electrophotographic photosensitive member 501 is rotated in the direction of the arrow X at a prescribed speed and the surface of the photosensitive member 501 is uniformly charged by use of the corona charging device 502. Next, the exposure L of an image is performed on the surface of the charged photosensitive member 501 and an electrostatic latent image of this image is formed on the surface of the photosensitive member 501. While the portion of the surface of the photosensitive member 501 where the electrostatic latent image is formed is passing the area where the developing device 504 is provided, a toner is supplied by the developing device 504 to the surface of the photosensitive member 501, the electrostatic latent image is made a visible image (development) as a toner image. With the rotation of the photosensitive member 501, this toner image reaches the area where the transfer charging device 506 is provided and is transferred to the transfer material 510 which is fed by a feed roller 511.

After the completion of transfer, a remaining toner is removed by the cleaner 505 from the surface of the electrophotographic photosensitive member 501 in order to make preparations for the next copying step, and charge elimination is performed by the charge elimination lamp 507 so that the potential of this surface becomes zero or almost zero, whereby one copying step is completed.

EXAMPLES

The present invention and its advantages are described by Examples in detail. It is to be understood that Examples are intended to illustrate some of the most preferred embodiments but not to limit the present invention.

Example 1

Electrophotographic photosensitive members for positive charging, each being constituted by a lower charge injection blocking layer, photoconductive layer and surface layer, outlined in FIG. 1A, was formed on a mirror-polished, cylindrical, aluminum substrate (diameter: 80 mm) were prepared by an electrophotographic photosensitive member production apparatus, based on RF-PCVD method and illustrated in FIG. 2, under the preparation conditions given in Table 1.

$O_2$ gas, $CF_4$ gas or mixed $CF_4$—$O_2$ (30%) gas flow rate, was set at X, Y or Z ppm (each relative to $SiH_4$ flow rate) while the surface layer was being deposited, in such a way to realize a peak content of oxygen atoms and/or fluorine atoms in the surface layer in the thickness direction. More specifically, each gas flow rate was changed at a constant rate in the peak formation region to realize a peak content of oxygen atoms, fluorine atoms, and oxygen atoms and fluorine atoms where film thickness W was set at 100 nm in the peak formation region.

The electrophotographic photosensitive members prepared were measured for the depth profile of content of oxygen atoms and/or fluorine atoms by SIMS (manufactured by CAMECA, trade name: IMS-4F). As for the conditions of measurement, $Cs^+$ having energy of 14.5 keV was used as a primary ion, and negative ions were detected as the secondary ions. At the time of completion of the measurement, the depth of the resulting sputter crater was actually measured by means of a stylus profilometer and the obtained sputter rate was used to convert the abscissa axis of the measured data from time to depth. It is confirmed, as shown in the depth profile in FIG. 3, that a peak content of oxygen atoms and/or fluorine atoms can be realized in the thickness direction in the surface layer by adequately controlling $O_2$ gas, $CF_4$ gas or mixed $CF_4$—$O_2$ (30%) gas flow rate while the surface layer is being deposited.

Electrophotographic photosensitive members were prepared with $O_2$ gas, $CF_4$ gas or mixed $CF_4$—$O_2$ (30%) gas flow rate X, Y or Z ppm (each relative to $SiH_4$ flow rate) changed, as given in Table 3, while the surface layer was being formed. The evaluation results for the electrophotographic photosensitive members are also given in Table 3.

Table 3 also gives the Omax/Omin and Fmax/Fmin ratios, where Omax: maximum content at the peak of the content distribution of oxygen atoms, Fmax: maximum content at the peak of the content distribution of fluorine atoms, Omin: minimum content of oxygen atoms in the surface layer, and Fmin: minimum content of fluorine atoms in the surface layer. These values were found from the depth profile analyzed for each electrophotographic photosensitive member by SIMS (manufactured by CAMECA, trade name: IMS-4F).

Comparative Example 1

An electrophotographic photosensitive member for positive charging, constituted by a lower charge injection blocking layer, photoconductive layer and surface layer, outlined in FIG. 1A, was formed on a mirror-polished, cylindrical, aluminum substrate (diameter: 80 mm) were prepared in the same manner as that for Example 1, under the preparation condition given in Table 2.

In Comparative Example 1, no $O_2$ gas, $CF_4$ gas or mixed $CF_4$—$O_2$ (30%) gas was introduced while the surface layer was being formed. There was no peak in the content distribution of oxygen atoms and fluorine atoms in the thickness direction in the surface layer, as confirmed by the SIMS analysis.

The electrophotographic photosensitive members for positive charging, prepared in each of Example 1 and Comparative Example 1, were set in a digital, electrophotographic apparatus (manufactured by Canon, trade name: iR-6000), outlined in FIG. 5, and evaluated for the items described later. The evaluation results are given in Table 3.

(1) Dot Reproducibility

The electrophotographic photosensitive members were set in an electrophotographic unit (manufactured by Canon, trade name: iR-6000). Current level of the main charging device and image exposure intensity were adjusted, and then printing was performed with a one-dot, one-space test pattern, in which dots were formed by switching on and off the laser for each pixel, to find an average value of the diameters of the developed dots. Dot reproducibility is defined as the absolute value of the difference between the average value of dot diameters and the spot diameter of the laser (breadth of $1/e^2$ at the maximum light intensity, e: base of natural logarithm). Dot reproducibility is better when the difference is smaller.

Dot reproducibility was classified according to the following criteria, where it is indicated in relative value when the value of the electrophotographic photosensitive member prepared in Comparative Example 1 is made 100%.

AA . . . Less than 85%, Very good
A . . . 85% or more to less than 95%, Good
B . . . On a level with that of Comparative Example 1, No practicle problem anticipated (2) Charging Capacity The electrophotographic photosensitive members were set in an electrophotographic apparatus. A high voltage of +6 kV was applied to a charging device to perform corona charging to measure the surface potential at the dark area of the electrophotographic photosensitive member by means of a surface potentiometer set at the developing device position.

Charging capacity was classified according to the following criteria, where it is indicated in relative value when the value of the electrophotographic photosensitive member prepared in Comparative Example 1 is made 100%.

AA . . . 115% or more, Very good
A . . . 105% or more to less than 115%, Good
B . . . On a level with that of Comparative Example 1, No practicle problem anticipated (3) Sensitivity The electrophotographic photosensitive members were treated with a corona discharge, and after current level of the charging device was adjusted to keep surface potential (dark potential) at +450V, image exposure (using semiconductor laser with a wavelength of 655 nm) was performed. The light intensity of the light source for the image exposure was then adjusted to keep surface potential (light potential) at +50V. The exposure quantity at that time is defined as the sensitivity.

Sensitivity was classified according to the following criteria, where it is indicated in relative value when the value of the electrophotographic photosensitive member prepared in Comparative Example 1 is made 100%.

AA . . . Less than 85%, Very good
A . . . 85% or more to less than 95%, Good
B . . . On a level with that of Comparative Example 1, No practicle problem anticipated (4) Optical Memory Optical memory potential is defined as difference between surface potential before image exposure and after image exposure and recharging, determined by the same potential sensor as that used for evaluation of sensitivity under the same conditions.

Optical memory potential was classified according to the following criteria, where it is indicated in relative value when the value of the electrophotographic photosensitive member prepared in Comparative Example 1 is made 100%.

AA . . . Less than 85%, Very good

A . . . 85% or more to less than 95%, Good

B . . . On a level with that of Comparative Example 1, No Practical problem anticipated As shown in Table 3, the electrophotographic photosensitive members exhibit improved dot reproducibility, when their surface layers are compositionally controlled to have a peak content of oxygen atoms and/or fluorine atoms, compared with the one prepared in Comparative Example 1, whose surface layer has no such peak content. Moreover, the electrophotographic photosensitive members prepared in Examples 1-b to 1-f, 1-i to 1-n, and 1-q to 1-u, having a peak in the content distribution of oxygen atoms and/or fluorine atoms in the thickness direction in such a way to satisfy the relationship $2 \leqq Omax/Omin \leqq 2000$ and/or $2 \leqq Fmax/Fmin \leqq 2000$ achieved effects of exhibiting improved dot reproducibility, charging capacity and sensitivity and lowered optical memory simultaneously, and notably, as compared with the one prepared in Comparative Example 1, whose surface layer has no such peak content.

Example 2

Next, half-value breadth of the peak content of oxygen atoms and/or fluorine atoms was investigated.

Electrophotographic photosensitive members for positive charging, each being constituted by a lower charge injection blocking layer, photoconductive layer and surface layer, outlined in FIG. 1A, formed on a mirror-polished, cylindrical, aluminum substrate (diameter: 80 mm) were prepared by an electrophotographic photosensitive member production unit, based on RF-PCVD method and illustrated in FIG. 2, under the preparation conditions given in Table 1.

In Example 2, $O_2$ gas, $CF_4$ gas and mixed $CF_4$—$O_2$ (30%) gas flow rates, X, Y and Z ppm relative to $SiH_4$ flow rate, respectively, were controlled at (1) X: 6 ppm, Y: 0 ppm and Z: 0 ppm, (2) X: 0 ppm, Y: 14 ppm and Z: 0 ppm, or (3) X: 0 ppm, Y: 0 ppm and Z: 14.5 ppm. More specifically, each gas flow rate was changed at a constant rate in the peak formation region to realize a peak content of oxygen atoms, fluorine atoms, and oxygen atoms and fluorine atoms. At the same time, half-value breadth of the peak content of oxygen atoms and/or fluorine atoms was changed by changing only film thickness W [nm] of the peak formation region, to prepare electrophotographic photosensitive members for positive charging.

The electrophotographic photosensitive members thus prepared were evaluated in a manner similar to that for Example 1. The results are given in Table 4, where the peak half-value breadth is defined as the breadth at which the content of oxygen atoms and/or fluorine atoms is half of the level corresponding to the peak height in the depth profile in the vicinity of the peak (refer to FIG. 4).

As shown in Table 4, the electrophotographic photosensitive member prepared in each of Examples 2-b to 2-g, 2-j to 2-n, and 2-q to 2-u in such a way that oxygen atoms and/or fluorine atoms had a half-value breadth of 10 nm to 200 nm, inclusive, at the peak in the thickness direction in the surface layer achieved improved dot reproducibility, charging capacity and sensitivity and decreased optical memory simultaneously.

Example 3

Next, peak shape of the content distribution of oxygen atoms and/or fluorine atoms was investigated.

Electrophotographic photosensitive members for positive charging, each being constituted by a lower charge injection blocking layer, photoconductive layer and surface layer, outlined in FIG. 1A, formed on a mirror-polished, cylindrical, aluminum substrate (diameter: 80 mm) were prepared by an electrophotographic photosensitive member production unit, based on RF-PCVD method and illustrated in FIG. 2, under the preparation conditions given in Table 1.

In Example 3, $O_2$ gas, $CF_4$ gas and mixed $CF_4$—$O_2$ (30%) gas flow rates, X, Y and Z ppm relative to $SiH_4$ flow rate, respectively, were controlled at (1) X: 5.5 ppm, Y: 0 ppm and Z: 0 ppm, (2) X: 0 ppm, Y: 12 ppm and Z: 0 ppm, or (3) X: 0 ppm, Y: 0 ppm and Z: 12 ppm. More specifically, each gas flow rate was changed at a constant rate in the peak formation region to realize a peak content of oxygen atoms, fluorine atoms, and oxygen atoms and fluorine atoms. At the same time, when the peak shape was to have a constant region, each gas was continued to cause to flow at a constant rate in the peak formation region. Thus, control was made so that the peak shape had a constant region.

In this example, film thickness W was set at 200 nm in the peak formation region. The electrophotographic photosensitive members for positive charging were prepared and evaluated in the same manner as that for Example 1. The results are given in Table 5.

As shown in Table 5, each of the electrophotographic photosensitive members achieved improved dot reproducibility, charging capacity and sensitivity and decreased optical memory simultaneously, when the peak of the content distribution of oxygen atoms and/or fluorine atoms in the surface layer did not have a constant region.

Example 4

An electrophotographic photosensitive member for negative charging for a color electrophotographic apparatus was investigated.

The electrophotographic photosensitive members constituted by a lower charge injection blocking layer, photoconductive layer, upper charge injection blocking layer composed of a region containing a Group 13 element of the periodic table and surface layer, outlined in FIG. 1B, formed on a mirror-polished, cylindrical, aluminum substrate (diameter: 80 mm) were prepared by an electrophotographic photosensitive member production unit, based on RF-PCVD method and illustrated in FIG. 2, under the preparation conditions given in Table 6.

$O_2$ gas, $CF_4$ gas or mixed $CF_4$—$O_2$ (30%) gas flow rate, was changed to X, Y or Z ppm (each relative to $SiH_4$ flow rate) while the surface layer was being deposited, in such a way to realize a peak content of oxygen atoms and/or fluorine atoms in the surface layer in the thickness direction. More specifically, each gas flow rate was changed at a constant rate in the peak formation region to realize a peak content of oxygen atoms, fluorine atoms, and oxygen atoms and fluorine atoms, where film thickness W was set at 120 nm in the peak formation region.

Each of the electrophotographic photosensitive members prepared under varying gas flow rates X, Y and Z [ppm] in Table 6 was evaluated. The results are given in Table 8.

Each electrophotographic photosensitive member was analyzed for the depth profile by SIMS (manufactured by CAMECA, trade name: IMS-4F). Table 8 gives the Omax/

Omin and Fmax/Fmin ratios, where Omax: maximum content at the peak of the content distribution of oxygen atoms, Fmax: maximum content at the peak of the content distribution of fluorine atoms, Omin: minimum content of oxygen atoms in the surface layer, and Fmin: minimum content of fluorine atoms in the surface layer. These values were found from the depth profile.

Comparative Example 2

An electrophotographic photosensitive member for negative charging, constituted by a lower charge injection blocking layer, photoconductive layer, upper charge injection blocking layer composed of a region containing a Group 13 element of the periodic table and surface layer, outlined in FIG. 1B, formed on a mirror-polished, cylindrical, aluminum substrate (diameter: 80 mm) was prepared in the same manner as that for Example 4, under the preparation conditions given in Table 7.

In Comparative Example 2, no $O_2$ gas, $CF_4$ gas or mixed $CF_4$—$O_2$ (30%) gas was introduced while the surface layer was being formed. There was no peak in the content distribution of oxygen atoms and fluorine atoms in the thickness direction in the surface layer, as confirmed by the SIMS analysis.

The electrophotographic photosensitive members for negative charging, prepared in Example 4 and Comparative Example 2, were set in a digital, electrophotographic apparatus (manufactured by Canon, trade name: iR-6000) that was modified for negative charging system evaluation, outlined in FIG. 5, and evaluated for the items described later. The evaluation results are given in Table 8.

(1) Dot Reproducibility

The electrophotographic photosensitive members were set in an electrophotographic unit (manufactured by Canon, trade name: iR-6000, modified for negatively charging system evaluation). Current level of the main charging device and image exposure intensity were adjusted, and then printing was performed with a one-dot, one-space test pattern, in which dots were formed by switching on and off the laser for each pixel, to find an average value of the diameters of the developed dots. Dot reproducibility is defined as the absolute value of the difference between the average value of dot diameters and the spot diameter of the laser (breadth of $1/e^2$ at the maximum light intensity, e: base of natural logarithm). Dot reproducibility is better when the difference is smaller.

Dot reproducibility was classified according to the following criteria, where it is indicated in relative value when the value of the electrophotographic photosensitive member prepared in Comparative Example 2 is made 100%.

AA . . . Less than 85%, Very good

A . . . 85% or more to less than 95%, Good

B . . . On a level with that of Comparative Example 2,

No practicle problem anticipated (2) Charging Capacity

The electrophotographic photosensitive members thus prepared were set in an electrophotographic apparatus (manufactured by Canon, trade name: iR6000, modified for negatively charging system evaluation). A high voltage of −6 kV was applied to a charging device to perform corona charging to measure the surface potential at the dark area of the electrophotographic photosensitive member by means of a surface potentiometer set at the developing device position.

Charging capacity was classified according to the following criteria, where it is indicated in relative value when the value of the electrophotographic photosensitive member prepared in Comparative Example 2 is made 100%.

AA . . . 115% or more, Very good

A . . . 105% or more to less than 115%, Good

B . . . On a level with that of Comparative Example 2,

No practical problem anticipated (3) Sensitivity

The electrophotographic photosensitive members thus prepared were treated with a corona discharge, and after current level of the charging device was adjusted to keep surface potential (dark potential) at −450V, image exposure (using semiconductor laser with a wavelength of 655 nm) was performed. The light intensity of the light source for the image exposure was then adjusted to keep surface potential (light potential) at −50V. The exposure quantity at that time is defined as the sensitivity.

Sensitivity was classified according to the following criteria, where it is indicated in relative value when the value of the electrophotographic photosensitive member prepared in Comparative Example 2 is made 100%.

AA . . . Less than 85%, Very good

A . . . 85% or more to less than 95%, Good

B . . . On a level with that of Comparative Example 2,

No Practical problem anticipated (4) Optical Memory

Optical memory potential is defined as difference between surface potential before image exposure and after image exposure and recharging, determined by the same potential sensor as that used for evaluation of sensitivity under the same conditions.

Optical memory potential was classified according to the following criteria, where it is indicated in relative value when the value of the electrophotographic photosensitive member prepared in Comparative Example 2 is made 100%.

AA . . . Less than 85%, Very good

A . . . 85% or more to less than 95%, Good

B . . . On a level with that of Comparative Example 2,

No practicle problem anticipated

As shown in Table 8, the electrophotographic photosensitive member for negative charging, having a region containing a Group 13 element of the periodic table, can exhibit improved dot reproducibility, charging capacity and sensitivity and lowered optical memory simultaneously, when its surface layer is compositionally controlled to have a peak content of oxygen atoms and/or fluorine atoms, compared with the one prepared in Comparative Example 2, whose surface layer has no such peak content.

Example 5

Next, electrophotographic photosensitive members for negative charging were prepared to have a varying layer structure.

Electrophotographic photosensitive members for negative charging, each being constituted by a lower charge injection blocking layer, photoconductive layer, intermediate layer, upper charge injection blocking layer composed of a region containing a Group 13 element of the periodic table and surface layer, outlined in FIG. 1C, formed on a mirror-polished, cylindrical, aluminum substrate (diameter: 80 mm) were prepared by an electrophotographic photosensitive member production apparatus, based on RF-PCVD method and illustrated in FIG. 2, under the preparation conditions given in Table 9.

$O_2$ gas, $CF_4$ gas or mixed $CF_4$—$O_2$ (30%) gas flow rate, was changed to X, Y or Z ppm (each relative to $SiH_4$ flow rate) while the intermediate layer was being deposited, in such a way to realize a peak content of oxygen atoms and/or fluorine atoms in the intermediate layer in the thickness direction. More specifically, each gas flow rate was changed at a constant rate in the peak formation region to realize a peak content of oxygen atoms, fluorine atoms and oxygen atoms and fluorine atoms, where film thickness W was set at 80 nm in the peak formation region.

Figure 6:
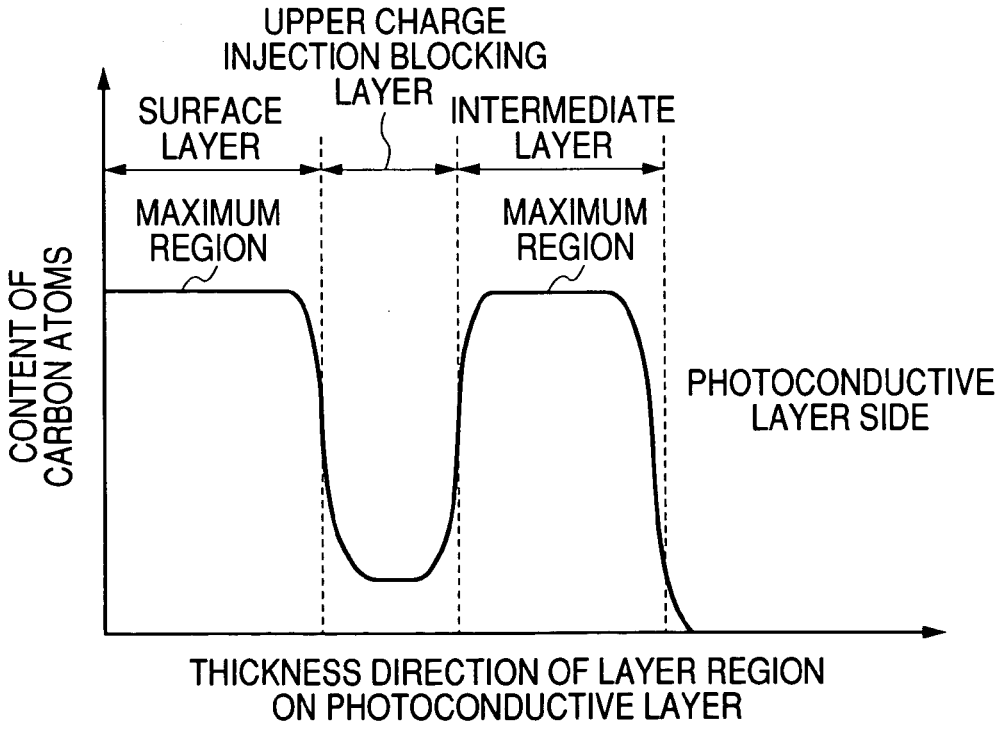
FIG. 6 is a graph which shows an example of the content distribution of carbon atoms in a thickness direction of a non-single-crystal layer region which is constituted by silicon atoms and carbon atoms as base materials in an electrophotographic photosensitive member for negative charging of the present invention.

The non-single-crystalline layer region, with silicon atoms and carbon atoms as the base materials, formed in this example is constituted by the intermediate layer, upper charge injection blocking layer and surface layer. As shown in FIG. 6, it had a carbon atom content distribution with two maximum regions in the film thickness direction, where the maximum regions of the carbon atom content to the total amount of the carbon and silicon atoms as the component atoms of the intermediate layer, upper charge injection blocking layer and surface layer were the same at 70 atomic %. At the same time, it had a constitution in which there were peaks of the content distribution of oxygen atoms, fluorine atoms, and oxygen atoms and fluorine atoms, in the thickness direction, in the layer region which is nearer to the photoconductive layer side than a minimum value present between the two maximum regions of the carbon atom content.

Figure 8:
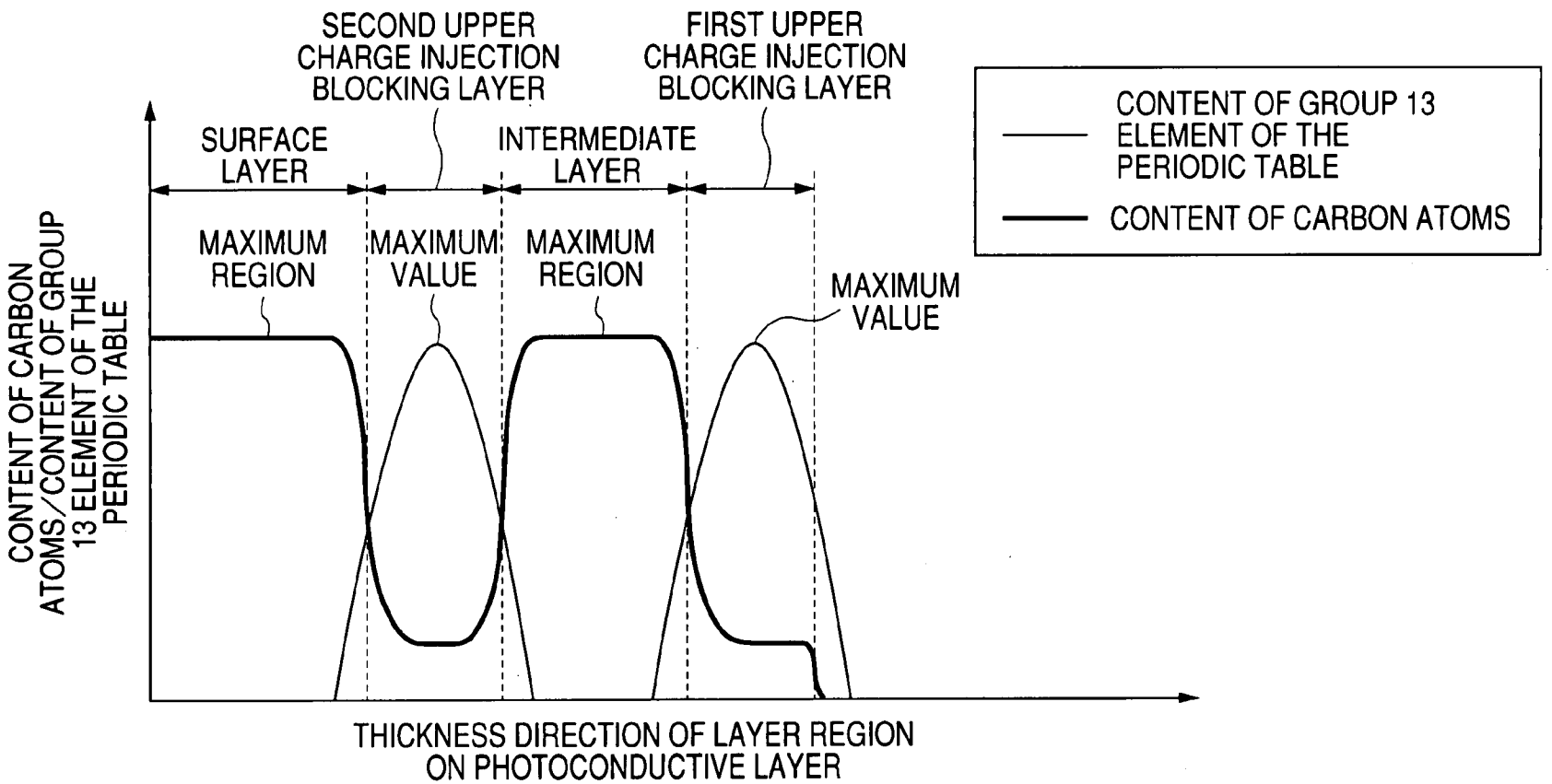
FIG. 8 is a graph which shows another example of the content distribution of carbon atoms and the content distribution of a Group 13 element of the periodic table in a thickness direction of a non-single-crystal layer region which is constituted of silicon atoms and carbon atoms as base materials in an electrophotographic photosensitive member for negative charging of the present invention.
Figure 9:
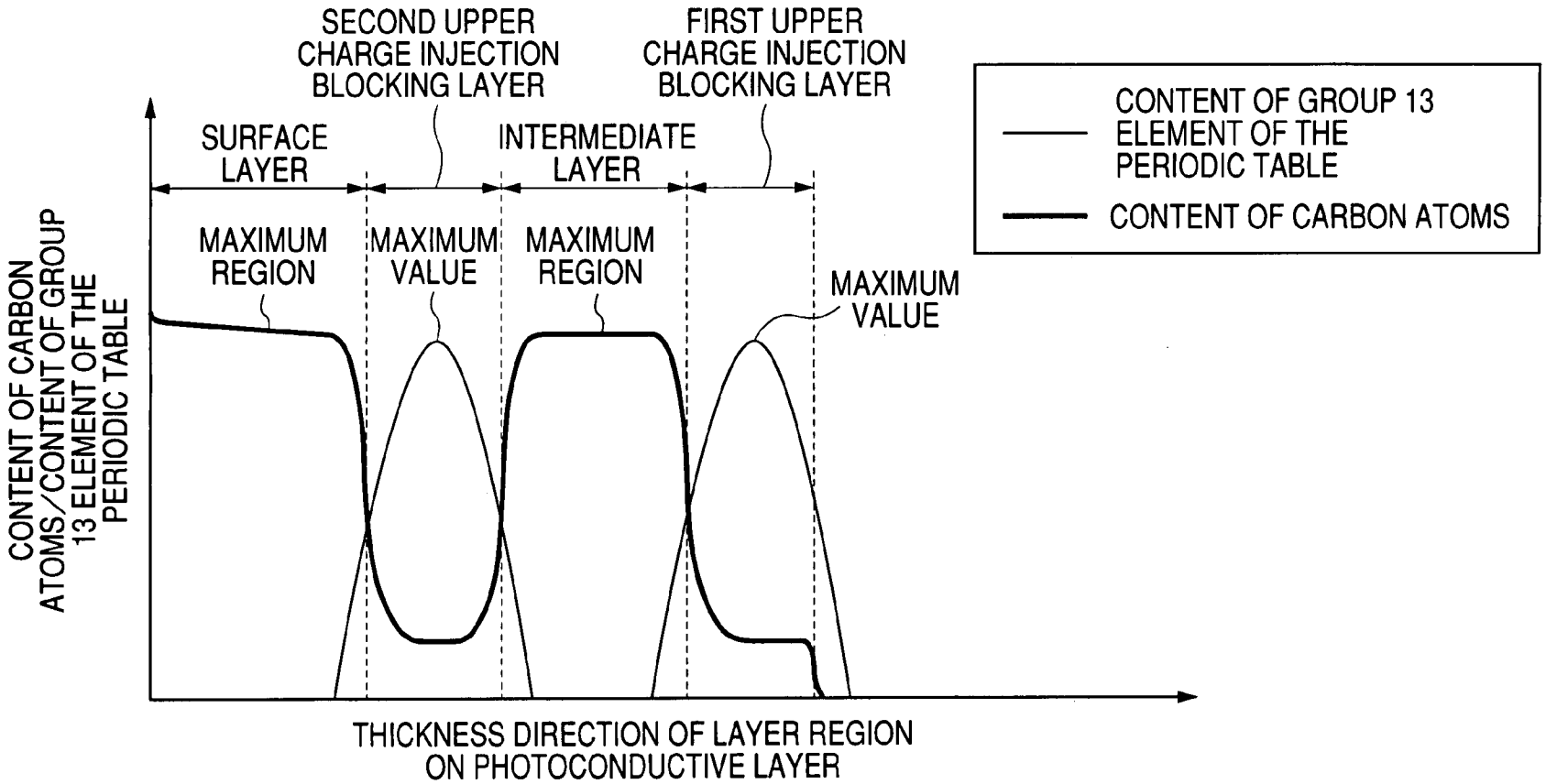
FIG. 9 is a graph which shows a further example of the content distribution of carbon atoms and the content distribution of a Group 13 element of the periodic table in a thickness direction of a non-single-crystal layer region which is constituted by silicon atoms and carbon atoms as base materials in an electrophotographic photosensitive member for negative charging of the present invention.

Also as shown in FIG. 6, the maximum region contained carbon atoms in a larger content than the content of carbon atoms in the lower charge injection blocking layer, and included the shape on the surface layer side. For the shape representing the content on the surface layer side, a shape in which the content of carbon atom is continued to increase on the surface layer side (refer to FIG. 9) is considered to have a maximum region. As shown in FIGS. 8 and 9, the shape of content distribution of the group 13 element of the periodic table in the upper charge injection blocking layer is deemed to be a maximum value.

Each of the electrophotographic photosensitive members for negative charging, prepared in Example 5, was set in a digital, electrophotographic apparatus (manufactured by Canon, trade name: iR-6000, modified for a negatively charging system evaluation), outlined in FIG. 5, to be evaluated in the same manner as that for Example 4. The evaluation results are given in Table 10.

As shown in Table 10, the electrophotographic photosensitive members for negative charging, having a region containing a Group 13 element of the periodic table, can exhibit improved dot reproducibility and sensitivity and decreased optical memory simultaneously, when its intermediate layer is compositionally controlled to have a peak content of oxygen atoms and/or fluorine atoms, compared with the one prepared in Comparative Example 2, which has no such peak content. The electrophotographic photosensitive member is also found to have improved sensitivity and optical memory, when compositionally controlled to have a peak content of oxygen atoms, fluorine atoms, and oxygen atoms and fluorine atoms in the thickness direction in the layer region nearer to the photoconductive layer side than the minimum value between the two maximum regions of carbon atom content.

Example 6

Next, electrophotographic photosensitive members for negative charging were also prepared to have a varying layer structure.

Electrophotographic photosensitive members for negative charging, each being constituted by a lower charge injection blocking layer, photoconductive layer, first upper charge injection blocking layer composed of an area containing a Group 13 element of the periodic table, intermediate layer, second upper charge injection blocking layer composed of a region containing a Group 13 element of the periodic table and surface layer, outlined in FIG. 1D, formed on a mirror-polished, cylindrical, aluminum substrate (diameter: 80 mm) were prepared by an electrophotographic photosensitive member production apparatus, based on RF-PCVD method and illustrated in FIG. 2, under the preparation conditions given in Table 11.

In this example, $O_2$ gas, $CF_4$ gas or mixed $CF_4$—$O_2$ (30%) gas flow rate, X, Y or Z ppm (each relative to $SiH_4$ flow rate), was changed (refer to Table 12) while the intermediate layer was being deposited, in such a way to realize a peak content of oxygen atoms and/or fluorine atoms in the intermediate layer in the thickness direction. More specifically, each gas flow rate was changed at a constant rate in the peak formation region to realize a peak content of oxygen atoms, fluorine atoms, and oxygen atoms and fluorine atoms, where film thickness W was set at 50 nm in the peak formation region.

Figure 7:
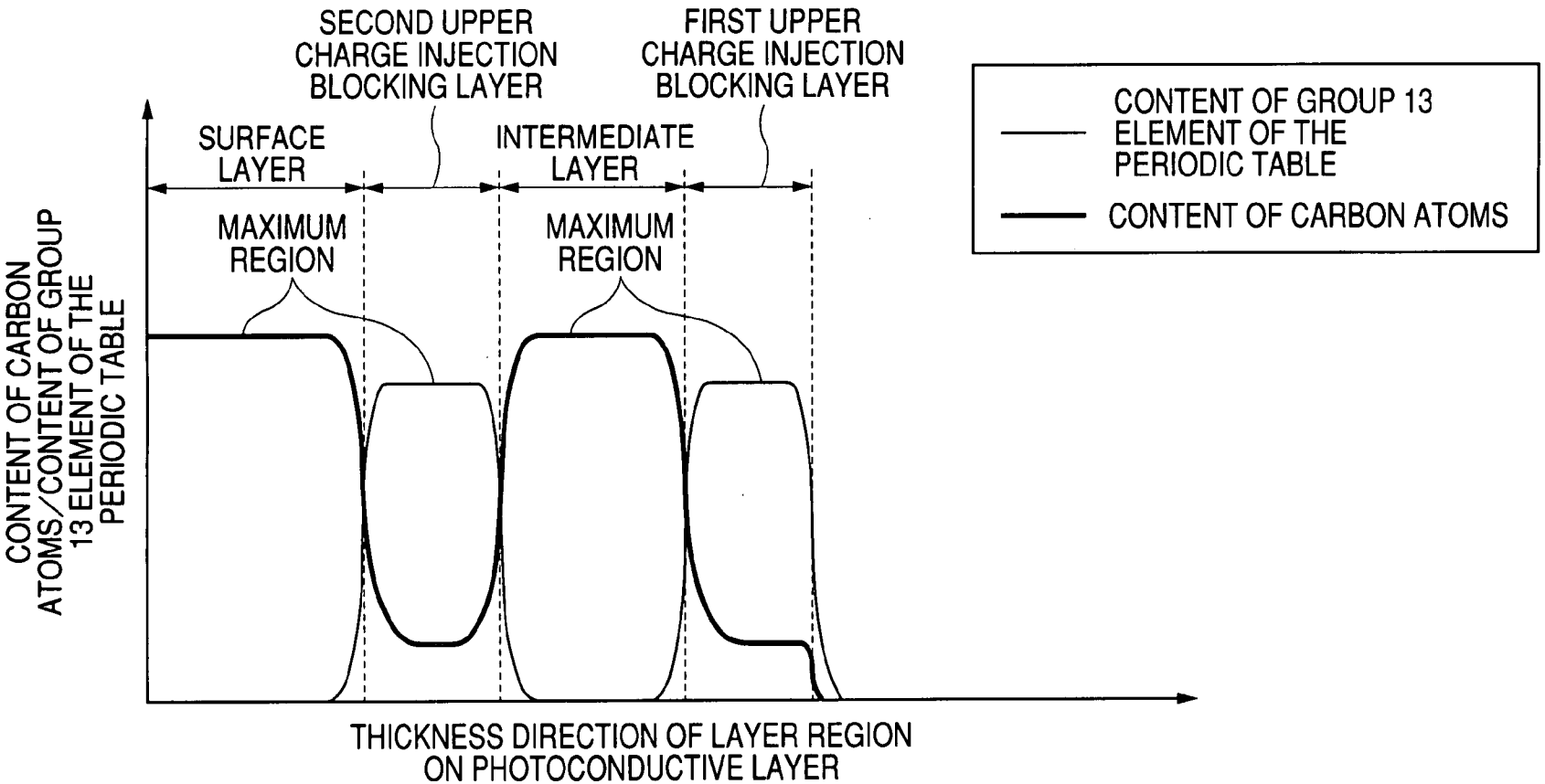
FIG. 7 is a graph which shows an example of the content distribution of carbon atoms and the content distribution of a Group 13 element of the periodic table in a thickness direction of a non-single-crystal layer region which is constituted by silicon atoms and carbon atoms as base materials in an electrophotographic photosensitive member for negative charging of the present invention.

The non-single-crystalline layer region, with silicon atoms and carbon atoms as the base materials, formed in this example was constituted by a first upper charge injection blocking layer, intermediate layer, second upper charge injection blocking layer and surface layer. It had a carbon atom content distribution with two maximum regions in the thickness direction, as shown in FIG. 7, where the maximum regions of the carbon atom content to the total amount of the carbon and silicon atoms as the component atoms of the first upper charge injection blocking layer, intermediate layer, second upper charge injection blocking layer and surface layer were the same and 70 atomic %. At the same time, it had a constitution in which there were peaks of the content distribution of oxygen atoms, fluorine atoms, and oxygen atoms and fluorine atoms, in the thickness direction, the layer region which is nearer to the photoconductive layer side than a minimum value between the two maximum regions of the carbon atom content.

Moreover, the first upper charge injection blocking layer and second upper charge injection blocking layer had the same contents of group 13 element of the periodic table (B: boron) that are each a maximum of 450 atomic ppm relative to the total amount of the constituent atoms in these layers, as confirmed by the SIMS analysis (manufactured by CAMECA, trade name: IMS-4F) for measurement of depth profile, and as shown in FIG. 7 there was obtained a curve having two maximum regions.

Each of the electrophotographic photosensitive members for negative charging, prepared in Example 6, was set in a digital, electrophotographic apparatus (manufactured by Canon, trade name: iR-6000, modified for a negatively charging system evaluation), outlined in FIG. 5, to be evaluated in the same manner as that for Example 5. The evaluation results are given in Table 12.

As shown in Table 12, the electrophotographic photosensitive-members for negative charging can exhibit improved dot reproducibility and sensitivity and decreased optical memory simultaneously, when its intermediate layer is compositionally controlled to have a peak content of oxygen atoms and/or fluorine atoms, compared with the one prepared in Comparative Example 2, which has no such peak content. The electrophotographic photosensitive members are also confirmed to have improved charging capacity by providing the first upper charge injection blocking layer and second upper charge injection blocking layer.

TABLE 1

| Gas species and flow rate | Lower charge injection blocking layer | Photoconductive layer | Surface layer: Region before peak formation | Surface layer: Peak formation region | Surface layer: Region after peak formation |
|---|---|---|---|---|---|
| $SiH_4$ [mL/min(normal)] | 150 | 200 | 15 | 15 | 15 |
| $H_2$ [mL/min(normal)] | 400 | 750 | — | — | — |
| $B_2H_6$ [ppm](relative to $SiH_4$) | 3000 | 0.15 | — | — | — |
| NO [%](relative to $SiH_4$) | 5 | — | — | — | — |
| $O_2$ [ppm](relative to $SiH_4$) | — | — | — | X | — |
| $CF_4$ [ppm](relative to $SiH_4$) | — | — | — | Y | — |
| Mixed $CF_4$—$O_2$ (30%) gas [ppm](relative to $SiH_4$) | — | — | — | Z | — |
| $CH_4$ [mL/min(normal)] | — | — | 550 | 550 | 550 |
| Pressure in the reactor [Pa] | 64 | 79 | 60 | 60 | 60 |
| Rf power [W](13.56 MHz) | 200 | 600 | 400 | 400 | 400 |
| Substrate temperature [° C.] | 260 | 260 | 260 | 260 | 260 |
| Film thickness [μm] | 3 | 30 | 0.3 | 0.1 | 0.4 |

TABLE 2

| Gas species and flow rate | Lower charge injection blocking layer | Photoconductive layer | Surface layer |
|---|---|---|---|
| $SiH_4$ [mL/min(normal)] | 150 | 200 | 15 |
| $H_2$ [mL/min(normal)] | 400 | 750 | — |
| $B_2H_6$ [ppm] (relative to $SiH_4$) | 3000 | 0.15 | — |
| NO [%] (relative to $SiH_4$) | 5 | — | — |
| $CH_4$ [mL/min(normal)] | — | — | 550 |
| Pressure in the reactor [Pa] | 64 | 79 | 60 |
| Rf power [W] (13.56 MHz) | 200 | 600 | 400 |
| Substrate temperature [° C.] | 260 | 260 | 260 |
| Film thickness [μm] | 3 | 30 | 0.8 |

TABLE 3

| | $0_2$ X[PPm] | $CF_4$ Y[PPm] | $CF_4$—$0_2$ Z[PPm] | Omax/ Omin | Fmax/ Fmin | Dot reproducibility | Charging capacity | Sensitivity | Optical memory potential |
|---|---|---|---|---|---|---|---|---|---|
| Example 1-a | 3 | 0 | 0 | 1.6 | No peak observed | A | A | A | A |
| Example 1-b | 4.5 | 0 | 0 | 2.0 | No peak observed | AA | AA | AA | AA |
| Example 1-c | 7 | 0 | 0 | 3.4 | No peak observed | AA | AA | AA | AA |
| Example 1-d | 25 | 0 | 0 | 12 | No peak observed | AA | AA | AA | AA |
| Example 1-e | 1600 | 0 | 0 | 1500 | No peak observed | AA | AA | AA | AA |
| Example 1-f | 2300 | 0 | 0 | 2000 | No peak observed | AA | AA | AA | AA |
| Example 1-g | 2700 | 0 | 0 | 2500 | No peak observed | A | AA | AA | A |
| Example 1-h | 0 | 4.9 | 0 | No peak observed | 1.4 | A | A | A | A |
| Example 1-i | 0 | 6.5 | 0 | No peak observed | 2.0 | AA | AA | AA | AA |
| Example 1-j | 0 | 8.0 | 0 | No peak observed | 2.5 | AA | AA | AA | AA |
| Example 1-k | 0 | 40 | 0 | No peak observed | 16 | AA | AA | AA | AA |
| Example 1-1 | 0 | 60 | 0 | No peak observed | 25 | AA | AA | AA | AA |
| Example 1-m | 0 | 1700 | 0 | No peak observed | 1600 | AA | AA | AA | AA |
| Example 1-n | 0 | 2100 | 0 | No peak observed | 2000 | AA | AA | AA | AA |
| Example 1-o | 0 | 2350 | 0 | No peak observed | 2300 | A | AA | AA | A |
| Example 1-p | 0 | 0 | 8.5 | 1.3 | 1.8 | A | AA | AA | AA |
| Example 1-q | 0 | 0 | 13.5 | 2.0 | 2.5 | AA | AA | AA | AA |
| Example 1-r | 0 | 0 | 30 | 4.5 | 6.1 | AA | AA | AA | AA |
| Example 1-s | 0 | 0 | 65 | 10 | 13 | AA | AA | AA | AA |
| Example 1-t | 0 | 0 | 1800 | 1200 | 1500 | AA | AA | AA | AA |
| Example 1-u | 0 | 0 | 2300 | 1800 | 2000 | AA | AA | AA | AA |
| Example 1-v | 0 | 0 | 2600 | 2200 | 2300 | A | AA | AA | A |

TABLE 4

| | $O_2$ X [ppm] | $CF_4$ Y [ppm] | $CF_4$—$O_2$ Z {ppm} | W [nm] | Omax/ Omin | Fmax/ Fmin | Half-value breadth of oxygen peak content [nm] | Half-value breadth of fluorine peak content [nm] | Dot repro-ducibility | Charging capacity | Sensi-tivity | Optical memory potential |
|---|---|---|---|---|---|---|---|---|---|---|---|---|
| Example 2-a | 6 | 0 | 0 | 15 | 3.4 | No peak observed | 5 | — | AA | A | A | AA |
| Example 2-b | 6 | 0 | 0 | 25 | 3.5 | No peak observed | 10 | — | AA | AA | AA | AA |
| Example 2-c | 6 | 0 | 0 | 35 | 3.6 | No peak observed | 15 | — | AA | AA | AA | AA |
| Example 2-d | 6 | 0 | 0 | 140 | 3.5 | No peak observed | 56 | — | AA | AA | AA | AA |
| Example 2-e | 6 | 0 | 0 | 330 | 3.5 | No peak observed | 150 | — | AA | AA | AA | AA |
| Example 2-f | 6 | 0 | 0 | 410 | 3.6 | No peak observed | 180 | — | AA | AA | AA | AA |
| Example 2-g | 6 | 0 | 0 | 450 | 3.5 | No peak observed | 200 | — | AA | AA | AA | AA |
| Example 2-h | 6 | 0 | 0 | 480 | 3.5 | No peak observed | 210 | — | A | AA | AA | A |
| Example 2-i | 0 | 14 | 0 | 15 | No peak observed | 4.1 | — | 6 | AA | A | A | AA |
| Example 2-j | 0 | 14 | 0 | 25 | No peak observed | 4.2 | — | 10 | AA | AA | AA | AA |
| Example 2-k | 0 | 14 | 0 | 35 | No peak observed | 4.3 | — | 14 | AA | AA | AA | AA |
| Example 2-l | 0 | 14 | 0 | 130 | No peak observed | 4.2 | — | 50 | AA | AA | AA | AA |
| Example 2-m | 0 | 14 | 0 | 380 | No peak observed | 4.1 | — | 170 | AA | AA | AA | AA |
| Example 2-n | 0 | 14 | 0 | 460 | No peak observed | 4.2 | — | 200 | AA | AA | AA | AA |
| Example 2-o | 0 | 14 | 0 | 490 | No peak observed | 4.2 | — | 220 | A | AA | AA | A |
| Example 2-p | 0 | 0 | 14.5 | 15 | 2.1 | 2.9 | 6 | 8 | AA | A | A | AA |
| Example 2-q | 0 | 0 | 14.5 | 20 | 2.2 | 3.0 | 10 | 12 | AA | AA | AA | AA |
| Example 2-r | 0 | 0 | 14.5 | 30 | 2.3 | 3.1 | 15 | 18 | AA | AA | AA | AA |
| Example 2-s | 0 | 0 | 14.5 | 120 | 2.2 | 3.0 | 50 | 56 | AA | AA | AA | AA |
| Example 2-t | 0 | 0 | 14.5 | 330 | 2.3 | 3.1 | 150 | 180 | AA | AA | AA | AA |
| Example 2-u | 0 | 0 | 14.5 | 400 | 2.2 | 3.1 | 180 | 200 | AA | AA | AA | AA |
| Example 2-w | 0 | 0 | 14.5 | 450 | 2.2 | 3.1 | 205 | 230 | AA | AA | A | A |
| Example 2-x | 0 | 0 | 14.5 | 500 | 2.1 | 3.1 | 215 | 241 | A | AA | AA | A |

TABLE 5

| | $O_2$ X[ppm] | $CF_4$ Y[ppm] | $CF_4$—$O_2$ Z[ppm] | Omax/ Omin | Fmax/ Fmin | Oxygen peak content shape | Flourine peak content shape | Dot reproducibility | Charging capacity | Sensitivity | Optical memory potential |
|---|---|---|---|---|---|---|---|---|---|---|---|
| Example 3-a | 5.5 | 0 | 0 | 3.1 | No peak observed | Constant region not observed | — | AA | AA | AA | AA |
| Example 3-b | 5.5 | 0 | 0 | 3.0 | No peak observed | Constant region observed | — | A | A | A | A |
| Example 3-c | 0 | 12 | 0 | No peak observed | 3.7 | — | Constant region not observed | AA | AA | AA | AA |
| Example 3-d | 0 | 12 | 0 | No peak observed | 3.7 | — | Constant region observed | A | A | A | A |
| Example 3-e | 0 | 0 | 12 | 2.0 | 2.6 | — | Constant region | AA | AA | AA | AA |

TABLE 5-continued

| | $O_2$ X[ppm] | $CF_4$ Y[ppm] | $CF_4$—$O_2$ Z[ppm] | Omax/ Omin | Fmax/ Fmin | Oxygen peak content shape | Flourine peak content shape | Dot reproducibility | Charging capacity | Sensitivity | Optical memory potential |
|---|---|---|---|---|---|---|---|---|---|---|---|
| Example 3-f | 0 | 0 | 12 | 1.9 | 2.6 | — | not observed Constant region observed | A | A | A | A |

TABLE 6

| Gas species and flow rate | Lower charge injection blocking layer | Lower charge Photoconductive layer | Upper charge injection blocking layer | Surface layer Region before peak formation | Surface layer Peak formation region | Surface layer Region after peak formation |
|---|---|---|---|---|---|---|
| $SiH_4$ [mL/min(normal)] | 120 | 200 | 45 | 18 | 18 | 18 |
| $H_2$ [mL/min(normal)] | 410 | 800 | — | — | — | — |
| $B_2H_6$ [ppm](relative to $SiH_4$) | — | — | 1000 | — | — | — |
| NO [%](relative to $SiH_4$) | 8 | — | — | — | — | — |
| $O_2$ [ppm](relative to $SiH_4$) | — | — | — | — | X | — |
| $CF_4$ [ppm](relative to $SiH_4$) | — | — | — | — | Y | — |
| Mixed $CF_4$—$O_2$ (30%) gas [ppm](relative to $SiH_4$) | — | — | — | — | Z | — |
| $CH_4$ [(mL/min(normal)] | — | — | 90 | 650 | 650 | 650 |
| Pressure in the reactor [Pa] | 60 | 75 | 55 | 55 | 55 | 55 |
| Rf power [W](13.56 MHz) | 150 | 450 | 150 | 150 | 150 | 150 |
| Substrate temperature [° C.] | 260 | 260 | 260 | 260 | 260 | 260 |
| Film thickness [μm] | 3 | 30 | 0.2 | 0.2 | 0.12 | 0.4 |

TABLE 7

| Gas species and flow rate | Lower charge injection blocking layer | Photo-conductive layer | Upper charge injection blocking layer | Surface layer |
|---|---|---|---|---|
| $SiH_4$ [mL/min(normal)] | 120 | 200 | 45 | 18 |
| $H_2$ [mL/min(normal)] | 410 | 800 | — | — |
| $B_2H_6$ [ppm] (relative to $SiH_4$) | — | — | 1000 | — |
| NO [%] (relative to $SiH_4$) | 8 | — | — | — |
| $CH_4$ [mL/min(normal)] | — | — | 90 | 650 |
| Pressure in the reactor [Pa] | 60 | 75 | 55 | 55 |
| Rf power [W] (13.56 MHz) | 150 | 450 | 150 | 150 |
| Substrate temperature [° C.] | 260 | 260 | 260 | 260 |
| Film thickness [μm] | 3 | 30 | 0.2 | 0.4 |

TABLE 8

| | $O_2$ X[ppm] | $CF_4$ Y[ppm] | $CF_4$—$O_2$ Z[ppm] | Omax/ Omin | Fmax/ Fmin | Dot reproducibility | Charging capacity | Sensitivity | Optical memory potential |
|---|---|---|---|---|---|---|---|---|---|
| Example 4-a | 5 | 0 | 0 | 2.5 | Peak not observed | AA | AA | AA | AA |
| Example 4-b | 0 | 10 | 0 | Peak not observed | 3.2 | AA | AA | AA | AA |
| Example 4-c | 0 | 0 | 20 | 3.1 | 4.1 | AA | AA | AA | AA |

TABLE 9

| Gas species and flow rate | Lower charge injection blocking layer | Photoconductive layer | Intermediate layer: Region before peak formation | Intermediate layer: Peak formation region | Intermediate layer: Region after peak formation | Upper charge injection blocking layer | Surface layer |
|---|---|---|---|---|---|---|---|
| $SiH_4$ [mL/min(normal)] | 120 | 200 | 25 | 25 | 25 | 45 | 25 |
| $H_2$ [mL/min(normal)] | 410 | 800 | — | — | — | — | — |
| $B_2H_6$ [ppm](relative to $SiH_4$) | — | — | — | — | — | 600 | — |
| NO [%](relative to $SiH_4$) | 8 | — | — | — | — | — | — |
| $O_2$ [ppm](relative to $SiH_4$) | — | — | — | X | — | — | — |
| $CF_4$ [ppm](relative to $SiH_4$) | — | — | — | Y | — | — | — |
| Mixed $CF_4$—$O_2$ (30%) gas [ppm](relative to $SiH_4$) | — | — | — | Z | — | — | — |
| $CH_4$ [mL/min(normal)] | — | — | 650 | 650 | 650 | 90 | 650 |
| Pressure in the reactor [Pa] | 60 | 75 | 55 | 55 | 55 | 55 | 55 |
| Rf power [W](13.56 MHz) | 150 | 450 | 150 | 150 | 150 | 150 | 150 |
| Substrate temperature [° C.] | 260 | 260 | 260 | 260 | 260 | 260 | 260 |
| Film thickness [μm] | 3 | 30 | 0.2 | 0.05 | 0.2 | 0.2 | 0.6 |

TABLE 10

| | $O_2$ X[ppm] | $CF_4$ Y[ppm] | $CF_4$—$O_2$ Z[ppm] | Omax/Omin | Fmax/Fmin | Dot reproducibility | Charging capacity | Sensitivity | Optical memory potential |
|---|---|---|---|---|---|---|---|---|---|
| Example 5-a | 5 | 0 | 0 | 2.6 | Peak not observed | AA | AA | AA | AA |
| Example 5-b | 0 | 10 | 0 | Peak not observed | 3.2 | AA | AA | AA | AA |
| Example 5-c | 0 | 0 | 20 | 3.2 | 4.1 | AA | AA | AA | AA |

TABLE 11

| Gas species and flow rate | Lower charge injection blocking layer | Photoconductive layer | First upper charge injection blocking layer | Intermediate layer: Region before peak formation | Intermediate layer: Peak formation region | Intermediate layer: Region after peak formation | Second upper charge injection blocking layer | Surface layer |
|---|---|---|---|---|---|---|---|---|
| $SiH_4$ [mL/min(normal)] | 120 | 200 | 45 | 25 | 25 | 25 | 45 | 25 |
| $H_2$ [mL/min(normal)] | 410 | 800 | — | — | — | — | — | — |
| $B_2H_6$ [ppm](relative to $SiH_4$) | — | — | 600 | — | — | — | 600 | — |
| NO [%](relative to $SiH_4$) | 8 | — | — | — | — | — | — | — |
| $O_2$ [ppm](relative to $SiH_4$) | — | — | — | — | X | — | — | — |
| $CF_4$ [ppm](relative to $SiH_4$) | — | — | — | — | Y | — | — | — |
| Mixed $CF_4$—$O_2$ (30%) gas [ppm](relative to $SiH_4$) | — | — | — | — | Z | — | — | — |
| $CH_4$ [mL/min(normal)] | — | — | 90 | 650 | 650 | 650 | 90 | 650 |
| Pressure in the reactor [Pa] | 60 | 75 | 55 | 55 | 55 | 55 | 55 | 55 |
| Rf power [W](13.56 MHz) | 150 | 450 | 150 | 150 | 150 | 150 | 150 | 150 |
| Substrate temperature [° C.] | 260 | 260 | 260 | 260 | 260 | 260 | 260 | 260 |
| Film thickness [μm] | 3 | 30 | 0.35 | 0.2 | 0.05 | 0.2 | 0.35 | 0.6 |

TABLE 12

| | $O_2$ X[ppm] | $CF_4$ Y[ppm] | $CF_4$—$O_2$ Z[ppm] | Omax/Omin | Fmax/Fmin | Dot reproducibility | Charging capacity | Sensitivity | Optical memory potential |
|---|---|---|---|---|---|---|---|---|---|
| Example 6-a | 8 | 0 | 0 | 3.9 | Peak not observed | AA | AA | AA | AA |
| Example 6-b | 0 | 15 | 0 | Peak not observed | 4.4 | AA | AA | AA | AA |
| Example 6-c | 0 | 0 | 30 | 4.5 | 6.4 | AA | AA | AA | AA |

What is claimed is:

1. An electrophotographic photosensitive member comprising a photoconductive layer on an electrically conductive substrate and a non-single-crystal layer region, wherein the photoconductive layer is formed from a non-single-crystal material constituted by at least silicon atoms as a base material, the non-single-crystal layer region is constituted by silicon atoms and carbon atoms as base materials, the non-single-crystal layer region is laminated on the photoconductive layer, the non-single-crystal layer region contains oxygen atoms, and the content distribution of oxygen atoms to a total amount of component atoms in a thickness direction within the non-single-crystal layer region has a peak formation shape.

2. The electrophotographic photosensitive member according to claim 1, wherein within said non-single-crystal layer region there is a region containing a Group 13 element.

3. The electrophotographic photosensitive member according to claim 1, wherein the content distribution of carbon atoms to a total amount of component atoms within said non-single-crystal layer region has at least two maximum regions in a thickness direction within the non-single-crystal layer region.

4. The electrophotographic photosensitive member according to claim 3, wherein in a thickness direction within a layer region which is nearer to the photoconductive layer side than a minimum value present between said two maximum regions of carbon atom content, there is a peak in said peak formation shape of the content distribution of oxygen atoms to a total amount of component atoms.

5. The electrophotographic photosensitive member according to claim 1, wherein when a maximum content at a peak in said peak formation shape of the content distribution of oxygen atoms within said non-single-crystal layer region is denoted by Omax and a minimum content of oxygen atoms contained within said non-single-crystal layer region is denoted by Omin, the ratio of the maximum content Omax to the minimum content Omin satisfies the relationship $2 \leqq Omax/Omin \leqq 2000$.

6. The electrophotographic photosensitive member according to claim 1, wherein at a peak in said peak formation shape of the content distribution of oxygen atoms within said non-single-crystal layer region, the half-value breadth of the peak is not less than 10 nm but not more than 200 nm.

7. The electrophotographic photosensitive member according to claim 1, wherein a peak of said peak formation shape of content distribution of oxygen atoms does not have a constant region.

8. An electrophotographic photosensitive member comprising a photoconductive layer on an electrically conductive substrate and a non-single-crystal layer region, wherein the photoconductive layer is formed from a non-single-crystal material constituted by at least silicon atoms as a base material, and the non-single-crystal layer region is constituted by silicon atoms and carbon atoms as base materials, the non-single-crystal layer region is laminated on the photoconductive layer, the non-single-crystal layer region contains fluorine atoms, and the content distribution of fluorine atoms to a total amount of component atoms in a thickness direction within the non-single-crystal layer region has a peak formation shape.

9. The electrophotographic photosensitive member according to claim 8, wherein within said non-single-crystal layer region there is a region containing a Group 13 element.

10. The electrophotographic photosensitive member according to claim 8, wherein the content distribution of carbon atoms to a total amount of component atoms within said non-single-crystal layer region has at least two maximum regions in a thickness direction within the non-single-crystal layer region.

11. The electrophotographic photosensitive member according to claim 10, wherein in a thickness direction within a layer region which is nearer to the photoconductive layer side than a minimum value present between said two maximum regions of carbon atom content, there is a peak in said peak formation shape of the content distribution of fluorine atoms to a total amount of component atoms.

12. The electrophotographic photosensitive member according to claim 8, wherein when a maximum content at a peak in said peak formation shape of the content distribution of fluorine atoms within said non-single-crystal layer region is denoted by Fmax and a minimum content of fluorine atoms contained within said non-single-crystal layer region is denoted by Fmin, the ratio of the maximum content Fmax to the minimum content Fmin satisfies the relationship $2 \leqq Fmax/Fmin \leqq 2000$.

13. The electrophotographic photosensitive member according to claim 8, wherein at a peak of said peak formation shape of the content distribution of fluorine atoms within said non-single-crystal layer region, the half-value breadth of the peak is not less than 10 nm but not more than 200 nm.

14. The electrophotographic photosensitive member according to claim 8, wherein a peak of said peak formation shape of content distribution of fluorine atoms does not have a constant region.

15. An electrophotographic photosensitive member comprising a photoconductive layer on an electrically conductive substrate and a non-single-crystal layer region, wherein the photoconductive layer is formed from a non-single-crystal material constituted by at least silicon atoms as a base material, the non-single-crystal layer region is constituted by silicon atoms and carbon atoms as base materials, the non-single-crystal layer region is laminated on the photoconductive layer, the non-single-crystal layer region contains oxygen atoms and fluorine atoms, the content distribution of oxygen atoms to a total amount of component atoms in a thickness direction within the non-single-crystal layer region has a peak, and the content distribution of fluorine atoms to a total amount of component atoms in a thickness direction within the non-single-crystal layer region has a peak formation shape, and the content distribution of fluorine atoms to a total amount of component atoms in a thickness direction within the non-single-crystal layer region has a peak formation shape.

16. The electrophotographic photosensitive member according to claim 15, wherein within said non-single-crystal layer region there is a region containing a Group 13 element.

17. The electrophotographic photosensitive member according to claim 15, wherein the content distribution of carbon atoms to a total amount of component atoms within said non-single-crystal layer region has at least two maximum regions in a thickness direction within the non-single-crystal layer region.

18. The electrophotographic photosensitive member according to claim 17, wherein in a thickness direction within a layer region which is nearer to the photoconductive layer side than a minimum value present between said two maximum regions of carbon atom content, there are peaks in said peak formation shapes peak of the content distribution of oxygen atoms and fluorine atoms to a total amount of component atoms.

19. The electrophotographic photosensitive member according to claim 15, wherein when a maximum content at peaks of said peak formation shapes of the content distribution of oxygen atoms and fluorine atoms within said non-single-crystal layer region is each denoted by Omax and Fmax and a minimum content of oxygen atoms and fluorine atoms contained within said non-single-crystal layer region is each denoted by Omin and Fmin, the ratio of the maximum content Omax, Fmax to the minimum content Omin, Fmin satisfies the relationship $2 \leqq Omax/Omin \leqq 2000$ and the relationship $2 \leqq Fmax/Fmin \leqq 2000$.

20. The electrophotographic photosensitive member according to claim 15, wherein at peaks of said peak formation shapes of the content distribution of oxygen atoms and fluorine atoms within said non-single-crystal layer region, the half-value breadth of each of the peaks is not less than 10 nm but not more than 200 nm for oxygen atoms and not less than 10 nm but not more than 200 nm for fluorine atoms.

21. The electrophotographic photosensitive member according to claim 15, wherein peaks of said peak formation shapes of content distribution of oxygen atoms and fluorine atoms do not have a constant region.

22. The electrophotographic photosensitive member according to claim 5, wherein said maximum content Omax satisfies $5.0\times10^{20}$ atoms/cm$^3 \leqq Omax \leqq 2.5\times10^{22}$ atoms/cm$^3$ and said minimum content Omin satisfies $2.5\times10^{17}$ atoms/cm$^3 \leqq Omin \leqq 1.3\times10^{22}$ atoms/cm$^3$.

23. The electrophotographic photosensitive member according to claim 12, wherein said maximum content Fmax satisfies $5.0\times10^{19}$ atoms/cm$^3 \leqq Fmax \leqq 2.0\times10^{22}$ atoms/cm$^3$ and said minimum content Fmin satisfies $2.5\times10^{17}$ atoms/cm$^3 \leqq Fmin \leqq 1.0\times10^{22}$ atoms/cm$^3$.

24. The electrophotographic photosensitive member according to claim 19, wherein said maximum content Omax satisfies $5.0\times10^{20}$ atoms/cm$^3 \leqq Omax \leqq 2.5\times10^{22}$ atoms/cm$^3$, said minimum content Omin satisfies $2.5\times10^{17}$ atoms/cm$^3 \leqq Omin \leqq 1.3\times10^{22}$ atoms/cm$^3$, said maximum content Fmax satisfies $5.0\times10^{19}$ atoms/cm$^3 \leqq Fmax \leqq 2.0\times10^{22}$ atoms/cm$^3$, and said minimum content Fmin satisfies $2.5\times10^{17}$ atoms/cm$^3 \leqq 1.0\times10^{22}$ atoms/cm$^3$.

* * * * *

UNITED STATES PATENT AND TRADEMARK OFFICE

CERTIFICATE OF CORRECTION

PATENT NO. : 7,211,357 B2
APPLICATION NO. : 10/901174
DATED : May 1, 2007
INVENTOR(S) : Kazuto Hosoi et al.

It is certified that error appears in the above-identified patent and that said Letters Patent is hereby corrected as shown below:

ON THE TITLE PAGE [56] REFERENCES CITED:

U.S. Patent Documents, "2003/0104029 A1" should read --2003/0104293 A1--.

COLUMN 10:

Line 58, "intermediate" should read --intermediate layer--;
Line 62, "intermediate" should read --intermediate layer--; and
Line 67, "ate" should read --ate layer--.

COLUMN 11:

Line 18, "intermediate" should read --intermediate layer--;
Line 23, "diate" should read --diate layer--;
Line 28, "intermediate" should read --intermediate layer--; and
Line 54, "intermediate" should read --intermediate layer--.

COLUMN 12:

Line 54, "$1x10^{31\ 1}$" should read --$10x10^{-1}$--.

COLUMN 14:

Line 26, "blocking" should read --blocking layer--; and
Line 38, "blocking" should read --blocking layer--.

COLUMN 16:

Line 21, "intermediate" should read --intermediate layer--;
Line 24, "intermediate" should read --intermediate layer--;
Line 33, "intermediate" should read --intermediate layer--;
Line 38, "intermediate" should read --intermediate layer--;
Line 48, "mediate" should read --mediate layer--; and
Line 57, "intermediate" should read --intermediate layer--.

COLUMN 30:

Line 58, "sitive-members" should read --sitive members--.

UNITED STATES PATENT AND TRADEMARK OFFICE

CERTIFICATE OF CORRECTION

PATENT NO. : 7,211,357 B2
APPLICATION NO. : 10/901174
DATED : May 1, 2007
INVENTOR(S) : Kazuto Hosoi et al.

It is certified that error appears in the above-identified patent and that said Letters Patent is hereby corrected as shown below:

COLUMN 33:

Line 6, "$CF_4$-$O_2$Z {ppm} " should read --$CF_4$-$O_2$ Z{ppm}--.

COLUMN 35:

Line 8, "2.6" should read --2.5--.

Signed and Sealed this

Eighteenth Day of December, 2007

JON W. DUDAS
*Director of the United States Patent and Trademark Office*